US012089694B2

(12) United States Patent
Nakaya et al.

(10) Patent No.: US 12,089,694 B2
(45) Date of Patent: Sep. 17, 2024

(54) SHOE

(71) Applicant: ASICS Corporation, Hyogo (JP)

(72) Inventors: Seigo Nakaya, Hyogo (JP); Genki Hatano, Hyogo (JP); Ayu Bessho, Hyogo (JP); Sho Takamasu, Hyogo (JP); Keita Ozawa, Hyogo (JP); Hiroki Nakamura, Hyogo (JP); Yousuke Atarashi, Hyogo (JP)

(73) Assignee: ASICS Corporation, Hyogo (JP)

( * ) Notice: Subject to any disclaimer, the term of this patent is extended or adjusted under 35 U.S.C. 154(b) by 339 days.

(21) Appl. No.: 17/601,678

(22) PCT Filed: Apr. 5, 2019

(86) PCT No.: PCT/JP2019/015188

§ 371 (c)(1),
(2) Date: Oct. 5, 2021

(87) PCT Pub. No.: WO2020/202564

PCT Pub. Date: Oct. 8, 2020

(65) Prior Publication Data

US 2022/0160080 A1 May 26, 2022

(51) Int. Cl.

| | |
|---|---|
| ***A43B 23/02*** | (2006.01) |
| ***A43B 7/14*** | (2022.01) |
| ***A43C 1/04*** | (2006.01) |

(52) U.S. Cl.
CPC ..... *A43B 23/0245* (2013.01); *A43B 7/1495* (2013.01); *A43C 1/04* (2013.01)

(58) Field of Classification Search
CPC ..... A43B 7/1495; A43B 7/24; A43B 23/0265; A43C 1/04

(Continued)

(56) References Cited

U.S. PATENT DOCUMENTS 2,068,251 A * 1/1937 Ullrich ..... A43B 7/1495 36/170
2,158,153 A * 5/1939 Roberts ..... A43B 23/047 12/142 E (Continued)

FOREIGN PATENT DOCUMENTS

CN 101827540 A 9/2010
CN 204181075 U 3/2015

(Continued)

OTHER PUBLICATIONS

Chinese Office Action issued in corresponding Chinese Patent Application No. 201980094876.8, dated Nov. 18, 2022, with English translation.

(Continued)

*Primary Examiner* — Ted Kavanaugh
(74) *Attorney, Agent, or Firm* — Rimon P.C.

(57) ABSTRACT

A shoe includes: an upper; a tightening tool disposed above an instep of a wearer and capable of applying, to the upper, tightening force for drawing portions and on the both sides in a foot width direction of the upper; and an arch support part provided such that tightening force applied to a first side portion in a foot width direction of the upper can be (Continued)

transmitted to the arch support part. The tightening force transmitter has stretchability in foot girth directions set higher than that of the arch support part.

7 Claims, 18 Drawing Sheets

(58) Field of Classification Search
USPC ..... 36/91
See application file for complete search history.

(56) References Cited

U.S. PATENT DOCUMENTS

| | | | | |
|---|---|---|---|---|
| 2,184,261 | A * | 12/1939 | Vamos | A43B 23/0295 36/51 |
| 2,188,182 | A * | 1/1940 | Gould | A43B 7/1495 36/170 |
| 8,225,534 | B2 | 7/2012 | Mueller et al. | |
| 8,375,602 | B2 | 2/2013 | Takada et al. | |
| 9,247,781 | B2 * | 2/2016 | Nishiwaki | A43C 1/00 |
| 2010/0205832 | A1 | 8/2010 | Takada et al. | |
| 2013/0192091 | A1 * | 8/2013 | Kohatsu | A43B 7/1495 36/103 |

FOREIGN PATENT DOCUMENTS

| | | | |
|---|---|---|---|
| CN | 101309607 | A | 11/2019 |
| JP | 2000-93204 | A | 4/2000 |
| JP | 2004-49738 | A | 2/2004 |
| JP | 2006-346316 | A | 12/2006 |
| JP | 2009-297151 | A | 12/2009 |
| JP | 2016-036703 | A | 3/2016 |
| WO | 2009/050819 | A1 | 4/2009 |
| WO | 2016/196900 | A1 | 12/2016 |

OTHER PUBLICATIONS

International Search Report issued in corresponding International Patent Application No. PCT/JP2019/015188, dated Jun. 25, 2019, with English translaiton.

International Preliminary Report on Patentability issued in corresponding International Patent Application No. PCT/JP2019/015188, dated Sep. 28, 2021, with English translaiton.

Extended European Search Report dated Mar. 2, 2022 issued in the corresponding European Patent Application No. 19923390.9.

* cited by examiner

SHOE

CROSS REFERENCE TO RELATED APPLICATIONS

This patent application is the U.S. National Phase under 35 U.S.C. § 371 of International Application No. PCT/JP2019/015188, filed on Apr. 5, 2019, the entire contents of which is hereby incorporated by reference in its entirety.

TECHNICAL FIELD

The present invention relates to a shoe.

BACKGROUND ART

In order to ensure the stability of running motion, preventing excessive pronation is desired. To achieve this, it is effective to prevent decrement of longitudinal arch height when the wearer's weight is applied to the foot. For example, Patent Literature 1 describes a shoe in which a reinforcement member is disposed within the upper so as to prevent decrement of longitudinal arch height.

PRIOR ART REFERENCE

Patent Literature

Patent Literature 1: Japanese Unexamined Patent Application Publication No. 2016-36703

SUMMARY OF INVENTION

The inventors have conducted study and gained the following new recognition. To restrain excessive pronation, there can be considered a method of providing, in a shoe, an arch support part to which tightening force of a tightening tool, such as a shoelace, is transmitted, so that the arch support part supports a longitudinal arch from the underneath. In this case, the arch support part is integrally formed with the upper, so that the tightening force to be applied to the arch support part may be dispersed and transmitted to the upper. This may cause large resistance in part of the upper other than the arch support part, so that the tightening force may not be sufficiently transmitted to the arch support part, which may therefore be unable to firmly support the longitudinal arch. With such a background issue, a shoe devised to restrain the lowering of a longitudinal arch has not been proposed.

One aspect of the present invention has been made in view of such an issue, and a purpose thereof is to provide a shoe which can prevent decrement of longitudinal arch Neigh of a foot.

To solve the abovementioned issue, one aspect of the present invention relates to a shoe. The shoe includes: an upper; a tightening tool disposed above an instep of a wearer and capable of applying, to the upper, tightening force for drawing portions on the both sides in a foot width direction of the upper; and an arch support part provided such that tightening force applied to a first side portion in a foot width direction of the upper can be transmitted to the arch support part. The arch support part is also provided to be capable of supporting, from the underneath, a longitudinal arch on a first side in the foot width direction of a foot of a wearer. The first side portion includes a tightening force transmitter provided on the first side in the foot width direction with respect to the arch support part and also provided such that the tightening force applied to the first side portion can be transmitted to the tightening force transmitter. The tightening force transmitter has stretchability in foot girth directions set higher than that of the arch support part.

To solve the abovementioned issue, another aspect of the present invention also relates to a shoe. The shoe includes: an upper; a tightening tool disposed above an instep of a wearer and capable of applying, to the upper, tightening force for drawing portions on the both sides in a foot width direction of the upper; and an arch support part provided such that tightening force applied to a first side portion in a foot width direction of the upper can be transmitted to the arch support part. The arch support part is also provided to be capable of supporting, from the underneath, a longitudinal arch on a first side in the foot width direction of a foot of a wearer. The first side portion includes a tightening force transmitter provided on the first side in the foot width direction with respect to the arch support part and also provided such that the tightening force applied to the first side portion can be transmitted to the tightening force transmitter. The tightening force transmitter is configured such that, when the tightening tool is being tightened, the tightening force is transmitted to the arch support part before the tightening force transmitter.

With a shoe of the present invention, decrement of longitudinal arch Neigh of a foot can be prevented.

DESCRIPTION OF EMBODIMENTS

Figure 1:
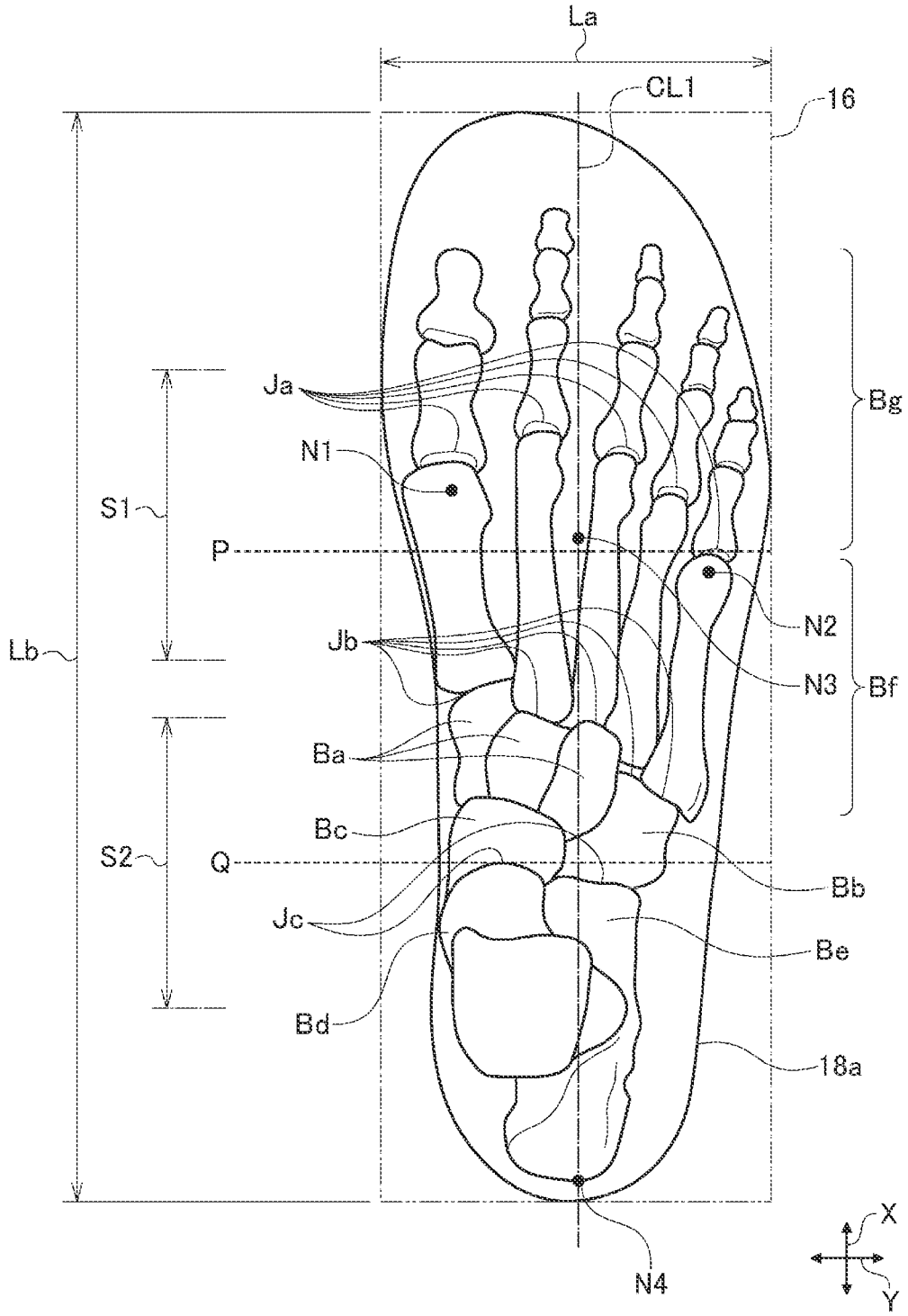
FIG. 1 is a schematic plan view in which a skeleton model of a human foot is superimposed upon an inner bottom surface of an accommodation room within an upper.

In the following, exemplary embodiments of the present invention will be described. Like reference characters denote like constituting elements, and repetitive description will be omitted. In each drawing, part of the constituting elements may be appropriately omitted, or the size of a constituting element may be appropriately enlarged or reduced, for the sake of convenience. Each drawing is to be viewed according to the direction of the reference characters. With regard to "fixing" and "being in contact" in the present specification, besides the case where two subject components directly satisfy a relevant condition, the case where the two subject components satisfy the relevant condition via another member is also included, unless otherwise specified.

Terms used in this specification will be described. With reference to FIG. 1, positional relationships in a plan view of a shoe 10 will be described. FIG. 1 is a plan view in which a skeleton model of a foot is superimposed upon an inner bottom surface 18*a* of an accommodation room 18 within an upper 14. Here is assumed a virtual rectangle 16 of which the four sides circumscribe the inner bottom surface 18*a* of the accommodation room 18 and of which a short side length La is minimum. A direction along a long side of the virtual rectangle 16 is defined as a "longitudinal direction X", and a direction along a short side thereof is defined as a "foot width direction Y". In a "longitudinal direction X", the front side is defined as the toe side of the foot, and the rear side is defined as the heel side of the foot. In a "foot width direction Y", the medial side is defined as the first toe side of the foot, and the lateral side is defined as the fifth toe side of the foot. When here is assumed a straight line passing through a midpoint N3 between the center N1 of the thenar eminence and the center N2 of the hypothenar eminence and through the center N4 of the heel, a "longitudinal direction X" also corresponds to a direction assumed to be parallel with the straight line. Also, a direction of circling around the axis of the longitudinal direction X is defined as a "foot girth direction". Further, a line extending along a longitudinal direction X and passing through a position that bisects the aforementioned short side length La of the virtual rectangle 16 will be referred to as a "center line CL1" of the shoe 10.

A human foot is mainly constituted by cuneiform bones Ba, a cuboid bone Bb, a navicular bone Bc, a talus Bd, a calcaneus Be, metatarsal bones Bf, and phalanges Bg. Joints of a foot include MP joints Ja, Lisfranc joints Jb, and a Chopart's joint Jc.

A "midfoot portion of a foot" means a portion from the MP joints Ja to the Chopart's joint Jc. A "longitudinal arch" of a foot means either a "medial longitudinal arch" or a "lateral longitudinal arch". The "medial longitudinal arch" means a region within a range from the calcaneus Be through the talus Bd, the navicular bone Bc, and the medial cuneiform bone Ba to the thenar eminence of the first metatarsal bone Bf on the medial side of a foot. The "lateral longitudinal arch" means a region within a range from the calcaneus Be through the cuboid bone Bb to the hypothenar eminence of the fifth metatarsal bone Bf on the lateral side of a foot.

The "midfoot portion" in terms of a constituting element of a shoe means a region assumed to be overlapped by the midfoot portion of a foot in plan view. A line P represents a straight line extending along a foot width direction Y and positioned within a range S1 from 50% to 75% of the entire length Lb of the shoe 10 from the heel side. A line Q represents a straight line extending along a foot width direction Y and positioned within a range S2 from 20% to 45% of the entire length Lb of the shoe 10 from the heel side. In this case, the "midfoot portion" in terms of a constituting element of a shoe means a region between the line P and the line Q in plan view.

The following embodiments describe examples in which the medial side is defined as a first side of the both foot width directions, and the lateral side is defined as a second side thereof. Also, the embodiments describe examples in which a supination direction is defined as a first side of the both foot girth directions, and a pronation direction is defined as a second side thereof. Each embodiment describes a shoe with which excessive pronation in the pronation direction can be prevented.

First Embodiment

Figure 2:
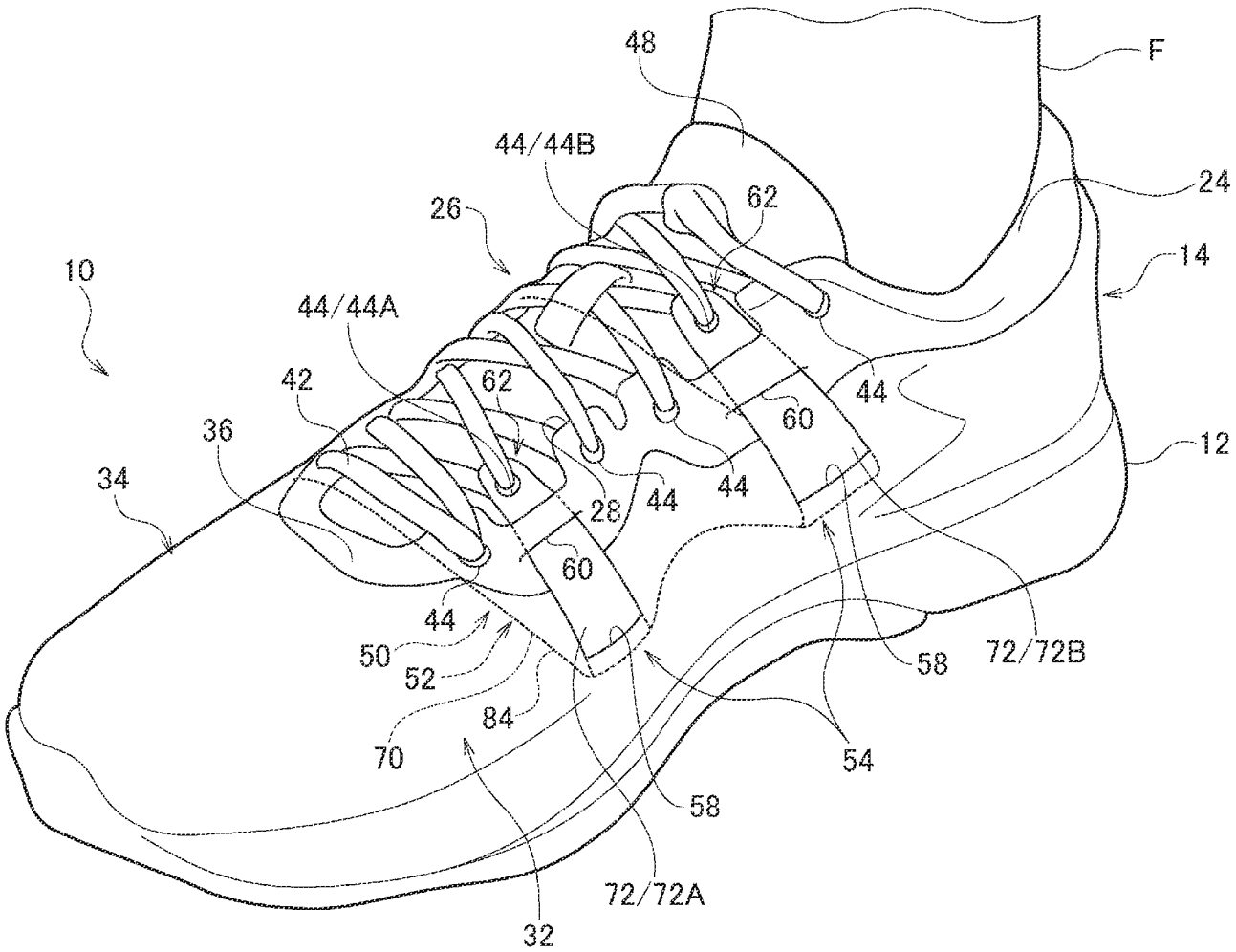
FIG. 2 is a schematic perspective view of a shoe according to a first embodiment viewed from a medial and front side of a foot.
Figure 3:
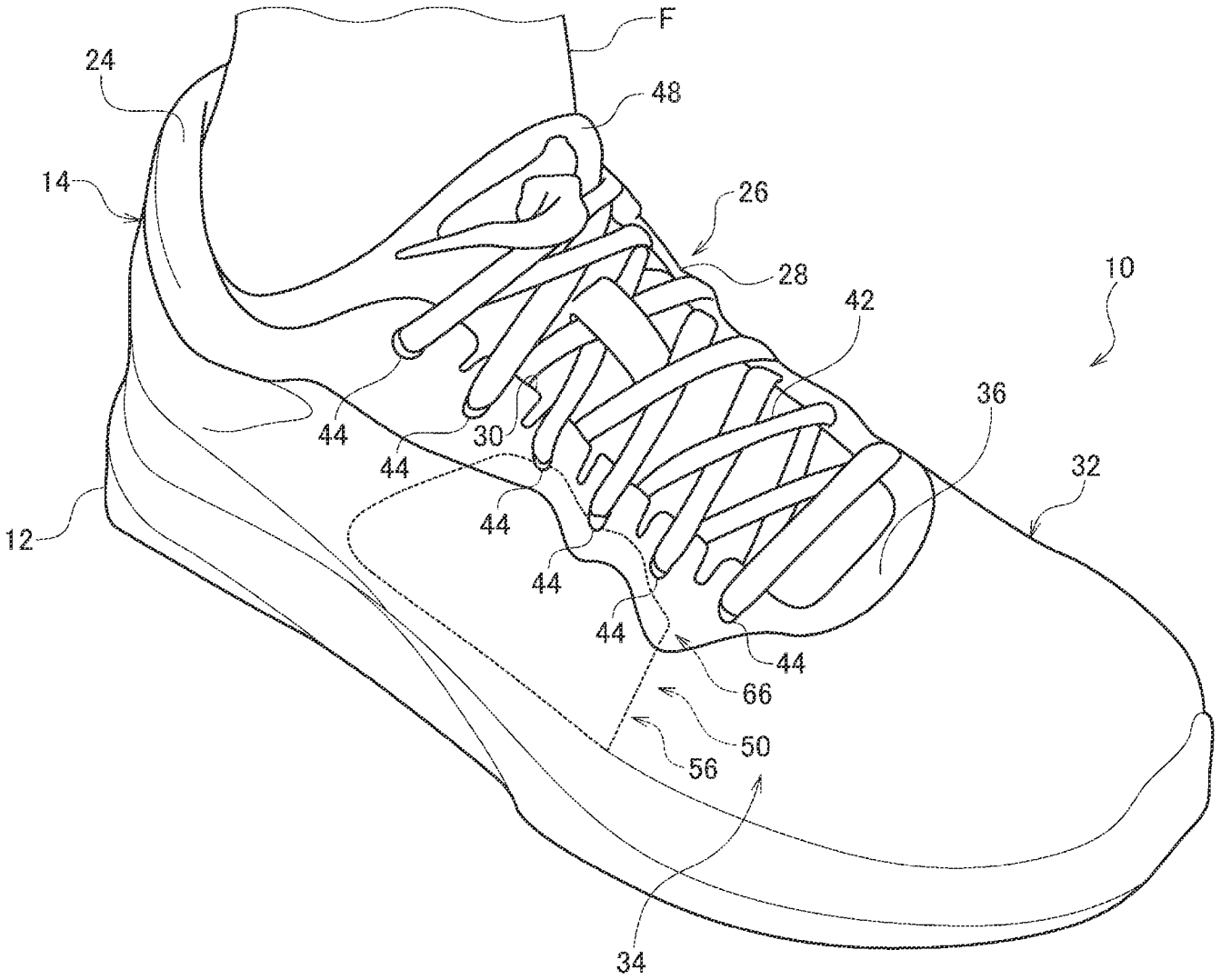
FIG. 3 is a schematic perspective view of the shoe according to the first embodiment viewed from a lateral and front side of a foot.
Figure 4:
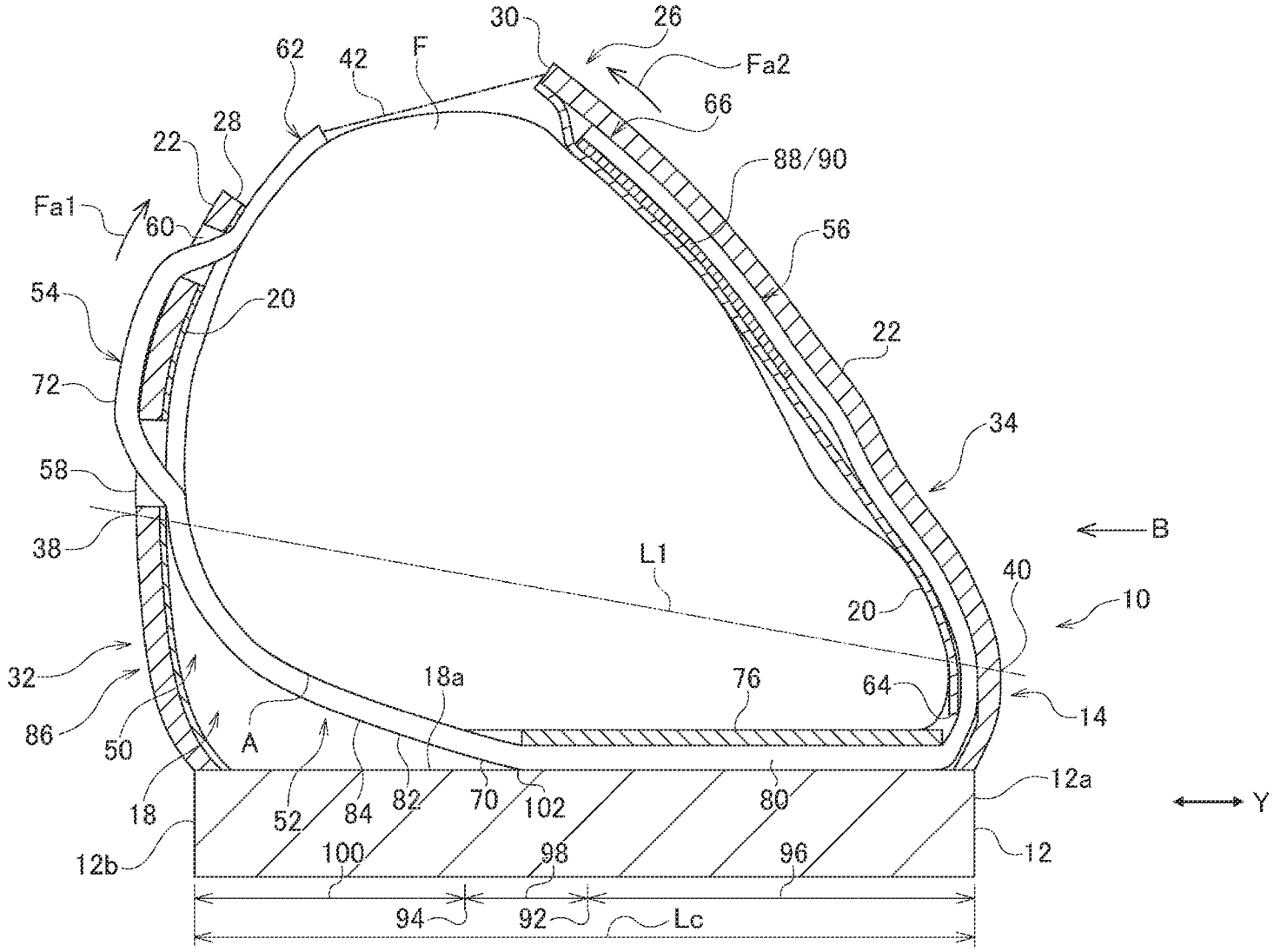
FIG. 4 is a schematic diagram that illustrates a cross section perpendicular to a longitudinal direction of the shoe according to the first embodiment, viewed from a rear side.

FIGS. 2-4 are now referred to. The shoe 10 according to the first embodiment will be described. Although a shoe for a right foot is illustrated, the following description is also applicable to a shoe for a left foot. The shoe 10 is used for running, for example. The running includes, besides the motion of running on general road surfaces, running motion in track and field, such as sprints, or ball sports and also includes walking motion.

The shoe 10 includes a sole 12 that supports a foot F of a wearer. The sole 12 in the present embodiment includes an outsole to be in contact with the ground. Besides the outsole, the sole 12 may also include one or more of a midsole, an insole, and an inner sole, which are laminated above the outsole, for example.

The shoe 10 also includes an upper 14 that wraps the foot F of the wearer. The upper 14 forms the accommodation room 18 that accommodates a foot between the upper 14 and the sole 12. The upper 14 covers a range from the toe to part of the instep of a foot from the above, covers a range from the toe to the heel of the foot from the both sides in a foot width direction Y, and covers the heel from the rear side. A lower circumferential edge part of the upper 14 is fixed to the sole 12 by bonding, sewing, or the like.

The upper 14 may be made of a material such as a texture and a fabric, or a leather material such as synthetic leather and artificial leather, for example. For the upper 14, a flexible material that matches a foot in shape is used. The upper 14 of the present embodiment has a multi-layered structure including an inner layer member 20 that forms the accommodation room 18, and an outer layer member 22 disposed outside the inner layer member 20.

On the upper 14, a wearing opening 24 is formed as a first opening that opens upward in a rear part of the upper 14. In a state where a wearer wears the shoe 10 (hereinafter, simply referred to as a wearing state), through the wearing opening 24, part of a foot, such as the ankle of the foot F, is inserted.

On the upper 14, a throat part 26 is formed as a second opening that continues to the wearing opening 24 and extends frontward from the wearing opening 24. The throat part 26 includes a medial side edge part 28 (a first side edge part) provided on the medial side in a foot width direction Y, and a lateral side edge part 30 (a second side edge part) provided on the lateral side. Each of the edge parts 28 and 30 is provided such as to extend from a rear end toward a front end of the throat part 26.

The upper 14 includes a medial side portion 32 (a first side portion) provided on the medial side in a foot width direction Y, and a lateral side portion 34 (a second side portion) provided on the lateral side in a foot width direction Y. The medial side portion 32 in the present embodiment is constituted by a portion located lower than the medial side edge part 28 of the throat part 26 in a longitudinal range in which the throat part 26 is provided and by a portion located on the medial side with respect to the aforementioned center line CL1, not illustrated, in a longitudinal range other than the longitudinal range in which the throat part 26 is provided. The lateral side portion 34 is constituted by a portion located lower than the lateral side edge part 30 of the throat part 26 in a longitudinal range in which the throat part 26 is provided and by a portion located on the lateral side with respect to the center line CL1, not illustrated, in a longitudinal range other than the longitudinal range in which the throat part 26 is provided.

The shoe 10 of the present embodiment includes a decorative member 36 fixed to the throat part 26. The decorative member 36 is provided along the throat part 26 continuously from the front end of the throat part 26 through the edge parts 28 and 30 on the both sides in a foot width direction to the wearing opening 24. The decorative member 36 may be made of a tape material or artificial leather, for example. The decorative member 36 is made of a material having lower stretchability than the upper 14 and is fixed to the upper 14 by bonding, sewing, or the like.

On a cross section perpendicular to a longitudinal direction X of the upper 14, a position located closest to the medial side is defined as a most medial end 38, a position located closest to the lateral side is defined as a most lateral end 40, and a straight line passing through the most medial end 38 and the most lateral end 40 will be referred to as a "reference line L1".

The shoe 10 includes a tightening tool 42 disposed above the instep of the wearer. With the tightening tool 42, tightening force for drawing the medial side portion 32 and the lateral side portion 34 of the upper 14 can be applied to the upper 14. The tightening tool 42 applies tightening force Fa1 in the supination direction to the medial side portion 32 of the upper 14 and applies tightening force Fa2 in the pronation direction to the lateral side portion 34 of the upper 14. The tightening tool 42 in the present embodiment applies the tightening force Fa1 in the supination direction to the medial side edge part 28 of the throat part 26 and applies the tightening force Fa2 in the pronation direction to the lateral side edge part 30 of the throat part 26. With the tightening force applied by the tightening tool 42, the upper 14 can fit onto the foot. Although the tightening tool 42 in the present embodiment is a shoelace, a specific example of the tightening tool 42 is not particularly limited as long as it can apply the tightening force, and the tightening tool 42 may be a belt, a wire, or the like.

On the portions 32 and 34 on the both sides in a foot width direction of the upper 14, a tightening tool insertion part 44 (hereinafter, simply referred to as an insertion part 44) through which the tightening tool 42 is inserted is provided. In the present embodiment, multiple insertion parts 44 are aligned with a space in between along a longitudinal direction, in each of the medial side portion 32 and the lateral side portion 34 of the upper 14. In the present embodiment, the insertion parts 44 are provided in the edge parts 28 and 30 of the throat part 26. Although the insertion parts 44 in the present embodiment are through holes through which the tightening tool 42 is inserted, the insertion parts 44 may also be grommets, shoelace hooks, or the like.

In the present embodiment, some of the insertion parts 44 are directly provided in the medial side portion 32 and the lateral side portion 34 of the upper 14, and other some of the insertion parts 44 are provided in a member (a support member 50 described later) separate from the upper 14 in the medial side portion 32. The insertion parts 44 provided directly in each of the portions 32 and 34 of the upper 14 are also provided in the decorative member 36. One end portion of the tightening tool 42 is inserted alternately through the insertion parts 44 in the medial side portion 32 and the insertion parts 44 in the lateral side portion 34 such as to be inserted through every other insertion part 44 in each of the alignments of multiple insertion parts 44. The other end portion of the tightening tool 42 is also inserted alternately through the insertion parts 44 in the medial side portion 32 and the insertion parts 44 in the lateral side portion 34 such as to be inserted through every other insertion part 44 in each of the alignments of multiple insertion parts 44.

The shoe 10 of the present embodiment includes a shoe tongue 48 provided such as to cover the throat part 26 in plan view. A front end of the shoe tongue 48 is fixed to the front end of the throat part 26 by sewing or the like, and a rear end of the shoe tongue 48 is a free end movable with respect to the upper 14.

The shoe 10 includes the support member 50 provided separately from the upper 14 and extending in a foot girth direction to form a strip shape. The support member 50 includes a medial bottom part 52 disposed between the foot and the sole 12, a medial side part 54 (a first side part) provided on the medial side in a foot width direction Y with respect to the medial bottom part 52, and a lateral side part 56 (a second side part) provided on the lateral side in a foot width direction Y with respect to the medial bottom part 52.

The medial side part 54 of the support member 50 is provided to extend in a foot girth direction along the medial side portion 32 of the upper 14. On the medial side portion 32 of the upper 14, a lower through hole 58 and an upper through hole 60, which open on the inner surface of the accommodation room 18, are formed at positions vertically spaced away from each other. Each of the through holes 58 and 60 in the present embodiment communicates with the inside and the outside of the upper 14. The medial side part 54 in the present embodiment is movably inserted through the lower through hole 58 and the upper through hole 60 of the upper 14. Toward its tip side, the medial side part 54 is provided such as to protrude from the lower through hole 58 of the upper 14 to the outside of the accommodation room 18 and to protrude from the upper through hole 60 of the upper 14 to the inside of the accommodation room 18. The medial side part 54 in the present embodiment is provided such as to be exposed to external space, in a range from the insertion position at the lower through hole 58 to the insertion position at the upper through hole 60. A tip part of the medial side part 54 in the present embodiment is disposed on the medial side edge part 28 of the throat part 26.

One end 62 in a long side direction of the support member 50 is located in the tip part of the medial side part 54. The one end 62 of the support member 50 in the present embodiment is disposed higher than the aforementioned reference line L1. The medial side part 54 of the support member 50 is disposed on the medial side in a foot width direction Y such as to vertically cross the reference line L1. The medial side part 54 is provided such that the tightening force Fa1 in the supination direction applied by the tightening tool 42 can be transmitted thereto. To achieve this, one of the aforementioned multiple insertion parts 44 is provided in the tip part of the medial side part 54, i.e., in the one end 62 of the support member 50.

In the present embodiment, multiple insertion parts 44 are provided in the support member 50 with a space in between along a longitudinal direction. These insertion parts 44 in the present embodiment include a first insertion part 44A on the front side, and a second insertion part 44B provided in the rear of the first insertion part 44A. In the present embodiment, between the first insertion part 44A and the second insertion part 44B, other insertion parts 44 directly provided in the medial side portion 32 of the upper 14 are arranged. The insertion parts 44 in the support member 50 constitute at least some of the aligned multiple insertion parts 44 provided in the medial side portion 32.

The lateral side part 56 of the support member 50 is provided to extend in a foot girth direction along the lateral side portion 34 of the upper 14. In the present embodiment, a slit 64 is formed in the inner layer member 20 in the lateral side portion 34 of the upper 14. Through the slit 64, the lateral side part 56 of the support member 50 is inserted between the outer layer member 22 and the inner layer member 20 of the upper 14. The lateral side part 56 of the support member 50 is provided such as not to be exposed to external space. The lateral side part 56 of the support member 50 is provided to cover the lateral side portion of the instep from the above in the wearing state.

The other end 66 in a long side direction of the support member 50 is located in the tip part of the lateral side part 56. The other end 66 of the support member 50 in the present embodiment is disposed higher than the aforementioned reference line L1. The lateral side part 56 of the support member 50 is disposed on the lateral side in a foot width direction Y such as to vertically cross the reference line L1. In the present embodiment, part of the lateral side part 56 of the support member 50 is disposed at a position that overlaps the lateral side edge part 30 of the throat part 26 and fixed to the lateral side edge part 30 by sewing or the like. The lateral side part 56 is fixed to the upper 14 at a position higher than the reference line L1. Unlike the one end 62 of the support member 50, in the other end 66 of the support member 50, the tightening tool insertion parts 44 are not provided.

The support member 50 includes a wide part 70, and a narrow part 72 that extends from the wide part 70 to the one end side of the support member 50 and has a narrower width in a longitudinal direction than the wide part 70. In the present embodiment, the wide part 70 is constituted by the medial bottom part 52 of the support member 50, and the narrow part 72 is constituted by the medial side part 54 of the support member 50. There are provided multiple narrow parts 72 of the support member 50 with a space in between along a longitudinal direction. The narrow parts 72 in the present embodiment include a first narrow part 72A on the front side, and a second narrow part 72B provided in the rear of the first narrow part 72A. The multiple insertion parts 44A and 44B are provided respectively in the multiple narrow parts 72A and 72B.

Figure 5A:
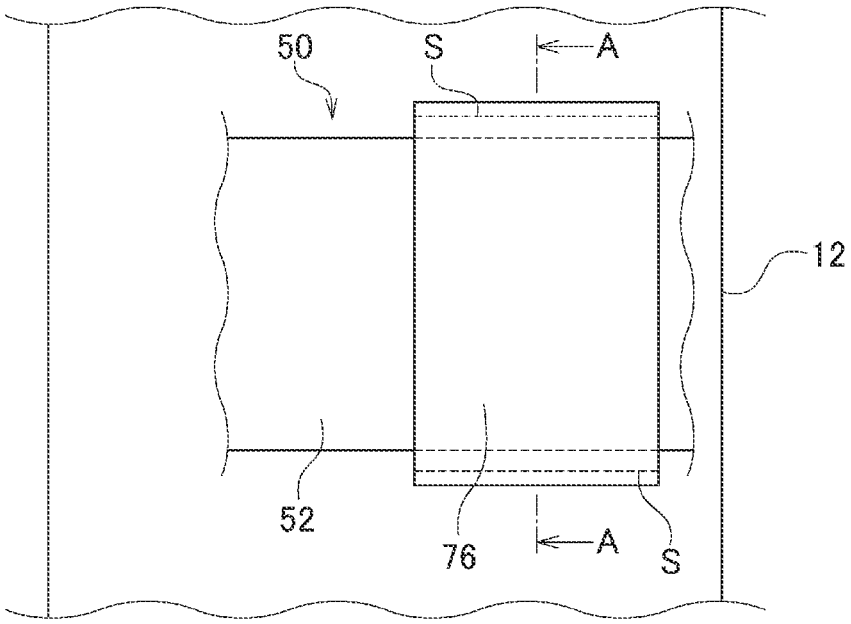
FIG. 5A is a schematic plan view of part of a sole with peripheral structure thereof in the first embodiment.
Figure 5B:
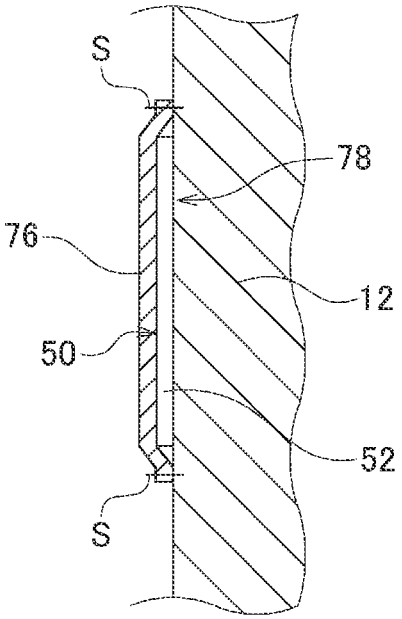
FIG. 5B is a sectional view taken along line A-A in FIG. 5A.

FIGS. 4 and 5 are now referred to. The "S" in the drawings indicates a sewn part. The shoe 10 includes a restraining part 76 that restrains movement in the vertical directions of the medial bottom part 52 of the support member 50 with respect to the sole 12 but allows movement in the foot girth directions of the medial bottom part 52. The restraining part 76 in the present embodiment is constituted by a member provided separately from the sole 12 and made of a flexible material, such as a texture and a fabric. The restraining part 76 is fixed at its front edge part or rear edge part to the upper surface of the sole 12 by sewing or the like, forming an insertion passage 78 through which the medial bottom part 52 of the support member 50 is inserted, between the restraining part 76 and the sole 12. With the medial bottom part 52 of the support member 50 inserted through the insertion passage 78 formed by the restraining part 76, movement in the vertical directions of the medial bottom part 52 is restrained while movement in the foot girth directions of the medial bottom part 52 is allowed, as described previously. The medial bottom part 52 of the support member 50 is provided to be movable in the foot girth directions with respect to the sole 12.

The medial bottom part 52 of the support member 50 includes a restrained region 80 provided on the lateral side in a foot width direction Y in the medial bottom part 52, and a movement allowable region 82 provided on the medial side in a foot width direction Y in the medial bottom part 52 with respect to the restrained region 80. In the restrained region 80, movement in the vertical directions is restrained by the restraining part 76. In the movement allowable region 82, movement in the vertical directions is not restrained by the restraining part 76, and a movable range in a vertical direction of the movement allowable region 82 is larger than that of the restrained region 80.

The description now returns to FIGS. 2-4. The shoe 10 includes an arch support part 84. The arch support part 84 in the present embodiment is provided on the medial side in the medial bottom part 52 of the support member 50. It can also be said that the arch support part 84 is provided in the wide part 70 of the support member 50. The arch support part 84 is constituted by the movement allowable region 82 of the support member 50 and provided to be movable in the vertical directions with respect to the sole 12. The arch support part 84 is provided such that the tightening force Fa1 in the supination direction applied to the medial side portion 32 of the upper 14 can be transmitted thereto. To the arch support part 84 in the present embodiment, the tightening force Fa1 in the supination direction is transmitted from the insertion parts 44 in the support member 50 provided in the medial side portion 32, through the support member 50 itself. The arch support part 84 is capable of supporting, from the underneath, a longitudinal arch A on the medial side in a foot width direction Y (the medial longitudinal arch) of the wearer's foot when tightening force is applied by the tightening tool 42 to the upper 14, as will be described later.

The medial side portion 32 of the upper 14 includes a tightening force transmitter 86 provided on the medial side with respect to the arch support part 84. The tightening force transmitter 86 is provided such that the tightening force Fa1 in the supination direction applied to the medial side portion 32 can be transmitted thereto. To achieve this, the tightening force transmitter 86 in the present embodiment is constituted by a portion of the medial side portion 32 of the upper 14 located lower than the aforementioned lower through hole 58. To this portion of the medial side portion 32, the tightening force Fa1 in the supination direction applied as described previously is transmitted from the medial side part 54 of the support member 50 via an inner wall surface of the lower through hole 58.

The stretchability in the foot girth directions of the tightening force transmitter 86 is set higher than that of the arch support part 84. In the present embodiment, the entire upper 14 is made of a material having higher stretchability in the foot girth directions, compared to the entire support member 50. To achieve this, the upper 14 may be made of Double Russel Mesh knitted from polyester yarn, and the support member 50 may be made of ether-based artificial leather, for example.

Figure 6:
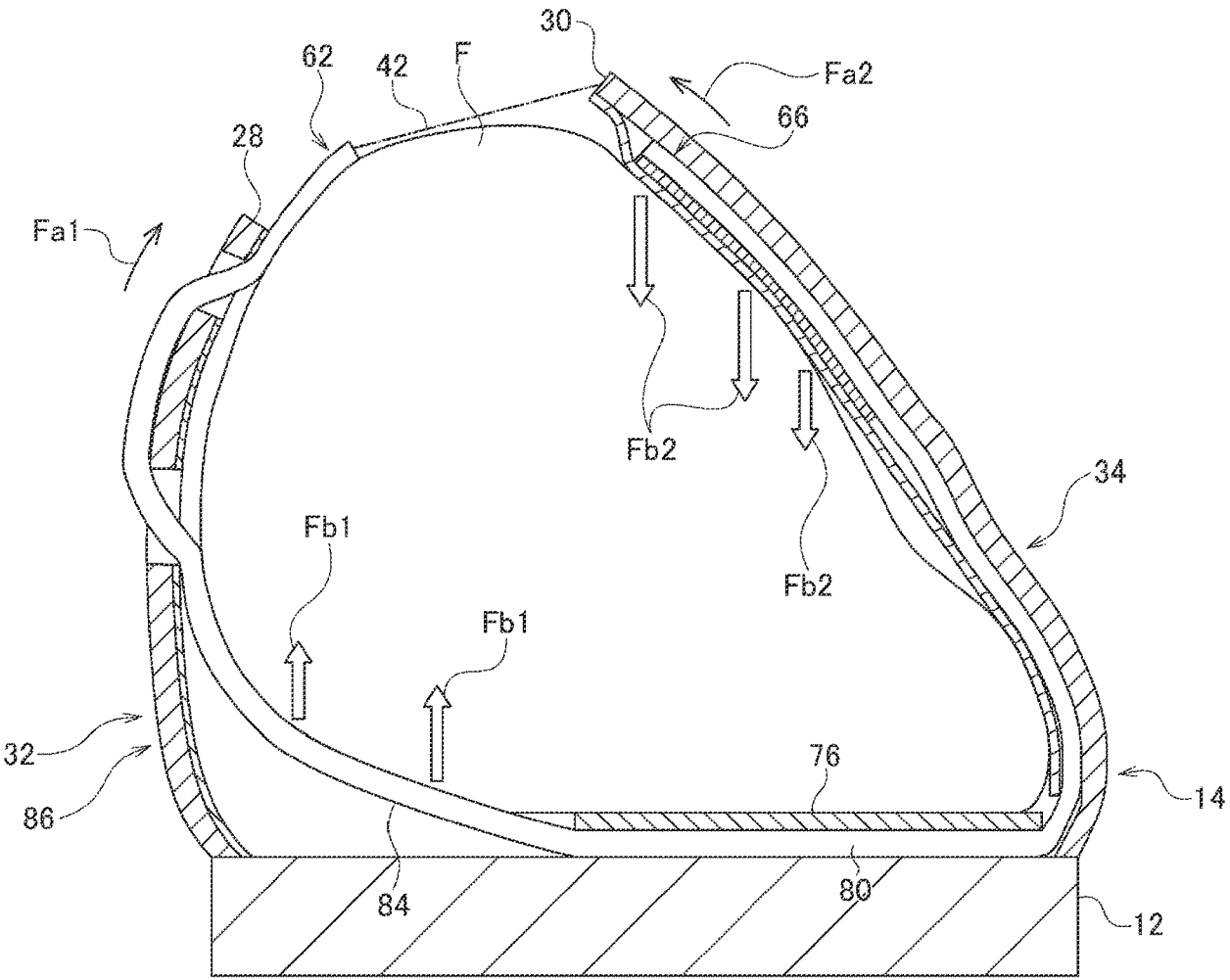
FIG. 6 is a diagram that schematically shows movements in the shoe according to the first embodiment.

There will be described the operation of the shoe 10 set forth above. FIG. 6 is now referred to. A case is considered in which the tightening tool 42 applies tightening force to the upper 14. The tightening force Fa1 in the supination direction is applied to the medial side portion 32 of the upper 14, and the tightening force Fa2 in the pronation direction is applied to the lateral side portion 34 of the upper 14.

When the tightening force Fa1 in the supination direction is applied to the medial side portion 32 of the upper 14, the tightening force Fa1 in the supination direction is transmitted to the arch support part 84, as described previously. The tightening force Fa1 in the supination direction allows the arch support part 84 to move in a vertical direction away from the sole 12 and to come into contact with the longitudinal arch A on the medial side from the underneath. At the time, the arch support part 84 applies upward force Fb1 in the supination direction to a position in contact with the longitudinal arch A and supports the longitudinal arch A on the medial side from the underneath. The arch support part 84 is disposed at a position that overlaps the midfoot portion of the upper 14 in side view, so as to support the midfoot portion on the medial side (the longitudinal arch on the medial side) of the foot.

When the tightening force Fa1 in the supination direction is thus applied to the medial side portion 32 of the upper 14, the tightening force Fa1 in the supination direction is transmitted to the tightening force transmitter 86 of the upper 14, as described previously.

There will be described effects provided by the shoe 10 set forth above.

(A) The tightening force transmitter 86 of the upper 14 is made of a material having higher stretchability than the material of the arch support part 84. Accordingly, when the tightening force Fa1 in the supination direction is applied to the medial side portion 32 of the upper 14, the tightening force transmitter 86 of the upper 14 is more likely to be deformed, compared to the case where the stretchability of the tightening force transmitter 86 is made identical with the stretchability of the arch support part 84. This can increase the tightening force transmitted to the arch support part 84, thereby increasing the upward force in the supination direction applied from the arch support part 84 to the foot. As a result, the longitudinal arch A on the medial side can be firmly supported by the arch support part 84 more easily, and lowering of the longitudinal arch A can be restrained, so that excessive pronation in the pronation direction can be restrained.

(B) The multiple insertion parts 44 in the support member 50 are provided with a space in between along a longitudinal direction. Accordingly, the arch support part 84 of the support member 50 can also be structured to extend in a large area in a longitudinal direction. Therefore, with the arch support part 84 of the support member 50, a large area of the longitudinal arch A on the medial side can be supported.

(C) Multiple insertion parts 44 are provided respectively in the multiple narrow parts 72. Accordingly, the arch support part 84 of the support member 50 can also be structured such that the wide part 70 of the support member 50 extends in a large area in a longitudinal direction. Therefore, with the arch support part 84 of the support member 50, a large area of the longitudinal arch A on the medial side can be supported.

In the support member 50, the medial bottom part 52 is provided to be movable in the foot girth directions with respect to the sole 12, the medial side part 54 is provided such that the tightening force Fa1 in the supination direction can be transmitted thereto, and the lateral side part 56 is fixed to the upper 14. Accordingly, when the tightening force Fa1 in the supination direction is transmitted to the medial side part 54 of the support member 50, the tightening force can be transmitted as downward force Fb2 in the supination direction to the lateral side portion 34 of the upper 14 via the medial bottom part 52 and the lateral side part 56 of the support member 50. With the downward force Fb2 in the supination direction applied from the upper 14 to the foot, excessive pronation in the pronation direction can be further restrained.

To obtain the effects described above, the shoe may be configured such that the tightening force Fa2 in the pronation direction transmitted from the tightening tool 42 to the lateral side portion 34 of the support member 50 becomes smaller than the tightening force Fa1 in the supination direction transmitted from the tightening tool 42 to the medial side portion 32 of the support member 50. To satisfy this condition, the present embodiment employs a structure in which the tightening tool insertion parts 44 are not provided in the other end 66 of the support member 50, as described below.

In the support member 50, tightening tool insertion parts 44 are provided in the one end 62 but are not provided in the other end 66. Accordingly, when the tightening tool 42 applies tightening force, the tightening force Fa1 in the supination direction is directly applied to the one end 62 of the support member 50, while the tightening force Fa2 in the pronation direction being directly applied to the other end 66 of the support member 50 can be prevented. This can avoid the situation where the tightening force Fa1 in the supination direction largely cancels out the tightening force Fa2 in the pronation direction, so that the downward force Fb2 in the supination direction can be effectively transmitted to the lateral side portion 34 of the upper 14 via the lateral side part 56 of the support member 50. Therefore, excessive pronation in the pronation direction can be further restrained.

In the restrained region 80 provided on the lateral side in the medial bottom part 52, movement in the vertical directions is restrained by the restraining part 76. Accordingly, upward force in the pronation direction is less likely to be applied from the restrained region 80 on the lateral side in the medial bottom part 52 to the foot F. Accordingly, the force Fb1 in the supination direction is applied from the arch support part 84 provided in the movement allowable region 82 of the medial bottom part 52 to the foot F, while a situation can be avoided in which force in the pronation direction is applied from the restrained region 80 of the medial bottom part 52 to the foot F. Therefore, excessive pronation in the pronation direction can be further restrained.

Other features of the shoe 10 according to the first embodiment will be described.

FIG. 4 is now referred to. The lower through hole 58 of the upper 14 in the present embodiment is provided higher than the aforementioned reference line L1.

Accordingly, the insertion position of the support member 50 at the lower through hole 58 in the medial side portion 32 is made higher than the reference line L1, which can increase the contact range in a vertical direction between the arch support part 84 of the support member 50 and the foot. Therefore, the longitudinal arch A on the medial side can be firmly supported by the arch support part 84 more easily, so that excessive pronation in the pronation direction can be further restrained.

Figure 7:
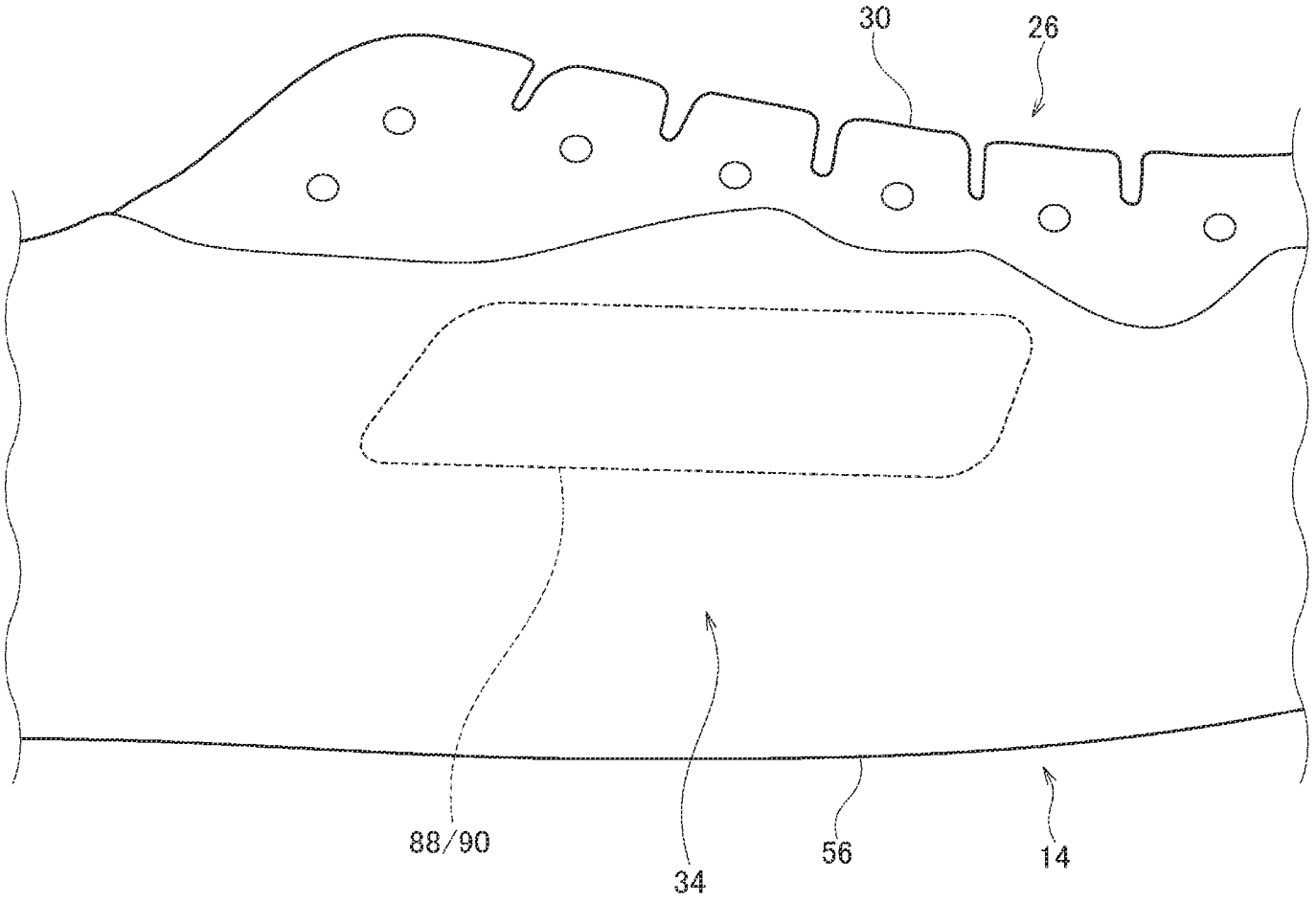
FIG. 7 is a schematic side view of the shoe viewed from the direction of arrow B in FIG. 4.
Figure 8:
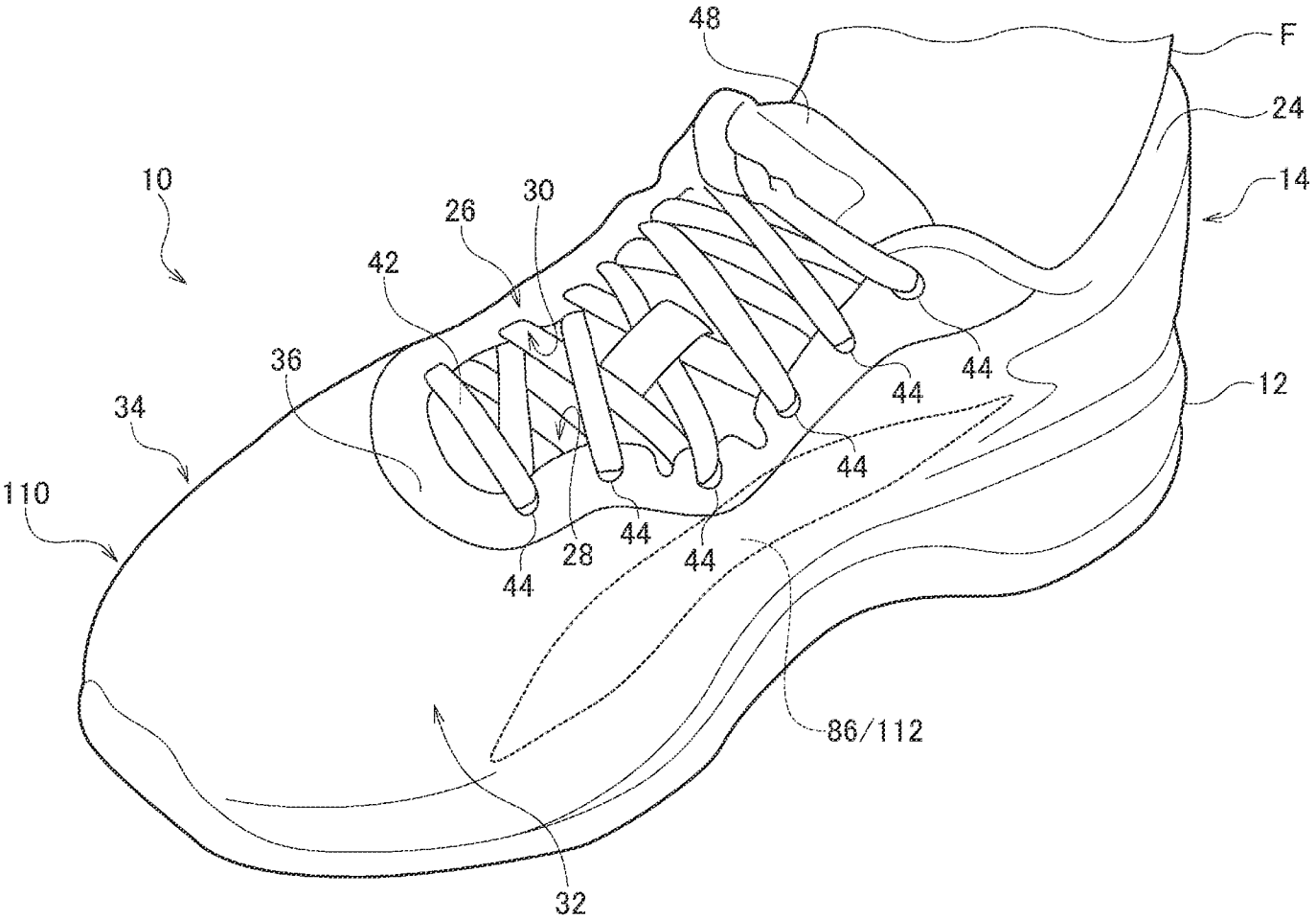
FIG. 8 is a schematic perspective view of a shoe according to a second embodiment viewed from a medial and front side of a foot.
Figure 9:
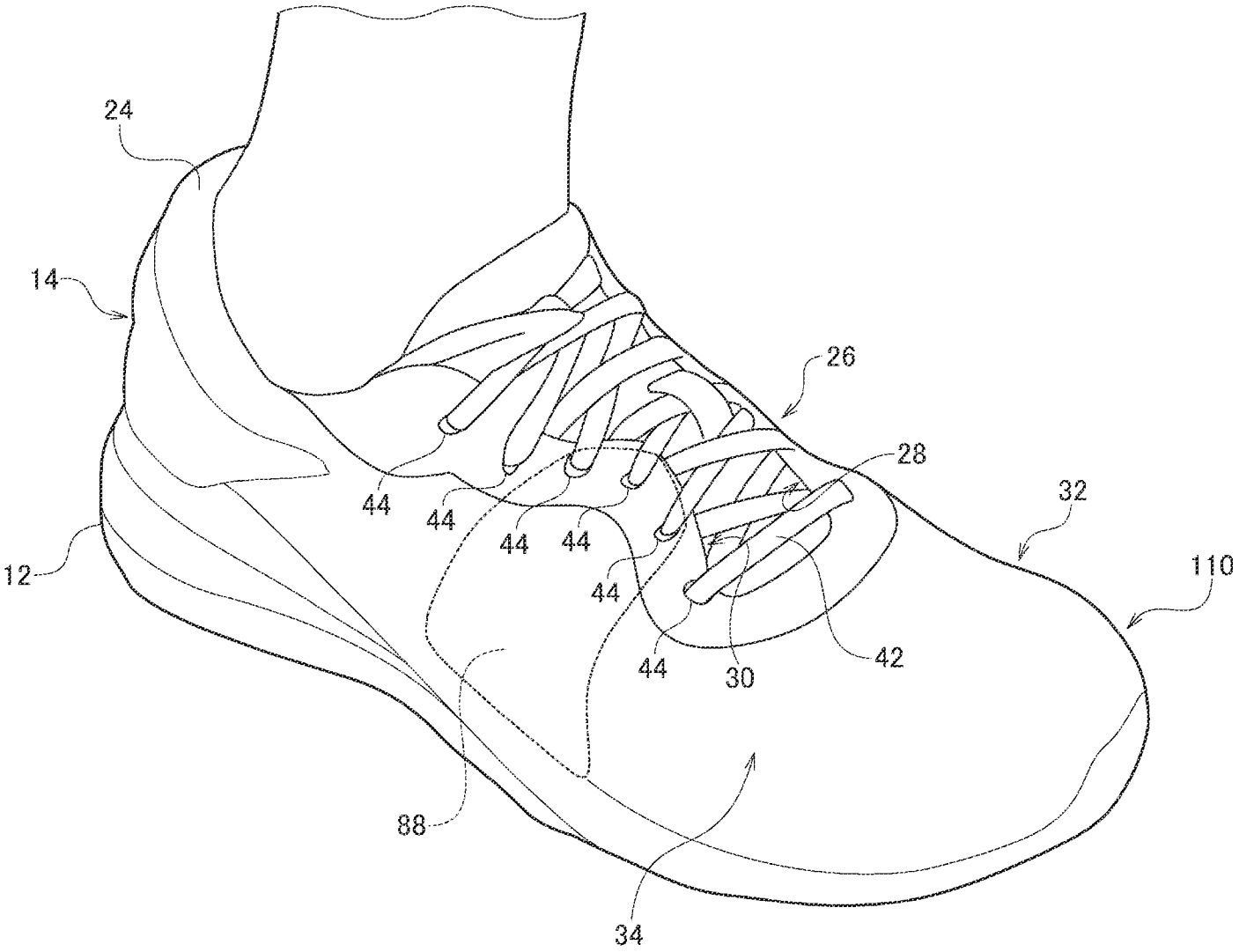
FIG. 9 is a schematic perspective view of the shoe according to the second embodiment viewed from a lateral and front side of a foot.
Figure 10:
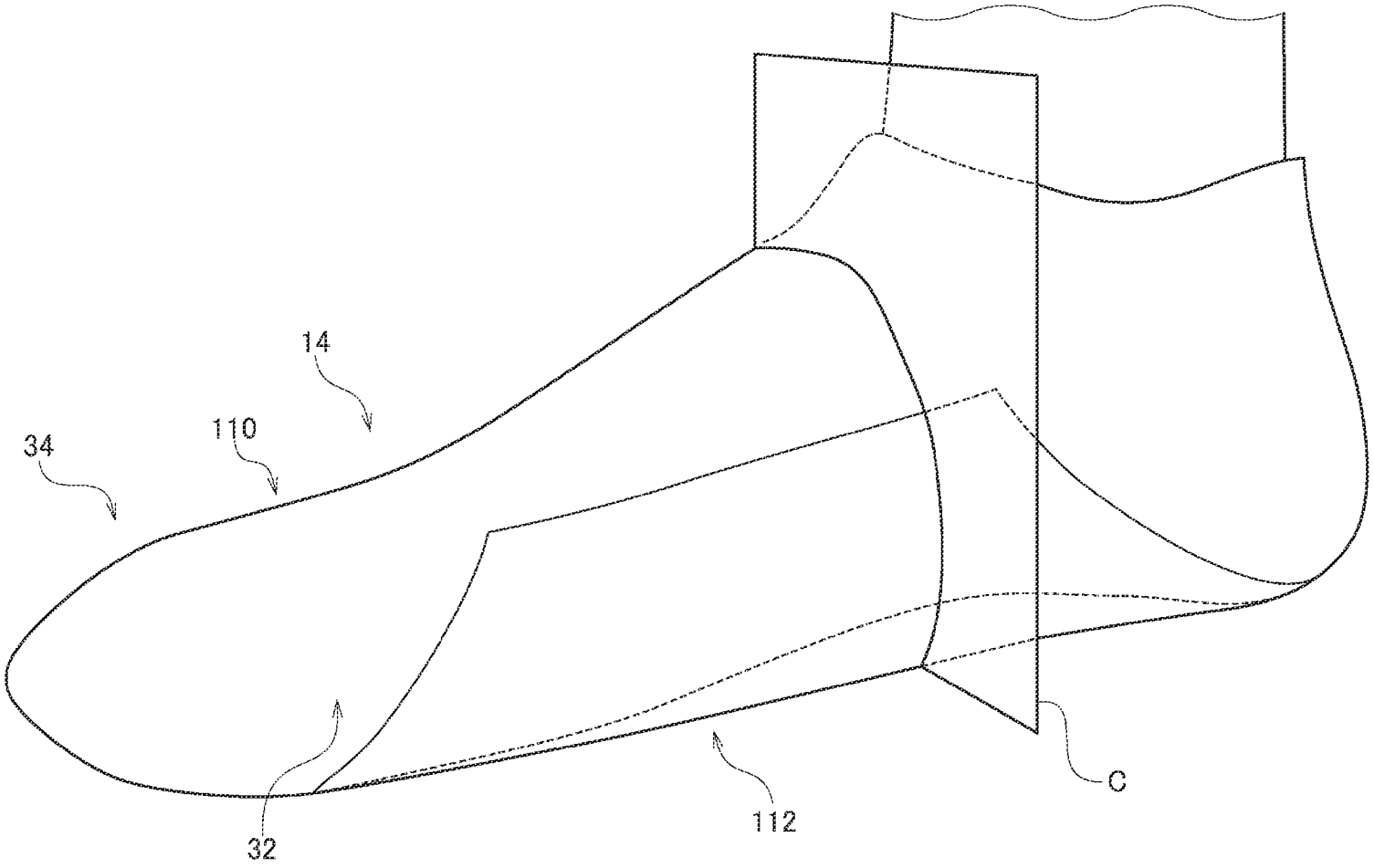
FIG. 10 is another schematic perspective view of part of the shoe according to the second embodiment viewed from a medial and front side of a foot.

FIGS. 4 and 7 are now referred to. The shoe 10 includes a restricting part 88 provided in the lateral side portion 34 of the upper 14. The restricting part 88 in the present embodiment is a cushion member 90 provided separately from the upper 14. The cushion member 90 is disposed between the outer layer member 22 and the inner layer member 20 of the upper 14. The cushion member 90 in the present embodiment may be formed in a rectangular shape in plan view, for example. In a non-deformed state, the cushion member 90 in the present embodiment has a cross section of rectangular shape perpendicular to a longitudinal direction of the cushion member 90.

The restricting part 88 may be provided along the lateral side edge part 30 of the throat part 26, for example. The restricting part 88 may suitably be provided higher than the aforementioned reference line L1. More specifically, the lower end position of the restricting part 88 may suitably be provided higher than the aforementioned reference line L1.

In the state where the longitudinal arch A on the medial side is supported by the arch support part 84, the restricting part 88 can restrict upward movement of the wearer's foot. In this state, the restricting part 88 in the present embodiment restricts the upward movement by means of repulsion caused by elastic deformation of the restricting part 88 itself. The restricting part 88 adjusts the repulsion of the cushion member 90 to bias, downward, the instep in the midfoot portion of the foot.

(D) Accordingly, when the wearer's foot is to move in the pronation direction, such movement can be restricted by the restricting part 88, so that excessive pronation in the pronation direction can be further restrained.

(E) Particularly, since the restricting part 88 biases the instep downward, movement of the wearer's foot in the pronation direction can be restrained, so that excessive pronation in the pronation direction can be further restrained.

Since the restricting part 88 is constituted by the cushion member 90, the restricting part 88 can be deformed to match the instep in shape, so that the area in the restricting part 88 in contact with the instep can be increased. Accordingly, the pressure applied to the instep through the restricting part 88 in the wearing state can be increased, so that excessive pronation in the pronation direction can be effectively restrained.

Since the cushion member 90 constituting the restricting part 88 is disposed between the outer layer member 22 and the inner layer member 20, large asperities are less likely to occur in the accommodation room 18 formed by the inner layer member 20. Accordingly, the inner surface of the accommodation room 18 feels smooth for the foot accommodated in the accommodation room 18, providing a good fit.

FIG. 4 is now referred to. Suitable positions of the restrained region 80 and the movement allowable region 82 in the medial bottom part 52 will be described. The shape of a cross section of the shoe 10 perpendicular to a longitudinal direction is considered. The dimension in a foot width direction Y of an upper surface part of the sole 12 is defined as Lc, the position of 50% of Lc from an end 12*a* on the lateral side is defined as a first reference position 92, and the position of 65% of Lc from the end 12*a* on the lateral side is defined as a second reference position 94. The upper surface part of the sole 12 is divided in a foot width direction Y from the lateral side toward the medial side into a first region 96, a second region 98, and a third region 100. The first region 96 is a region extending from the end 12*a* on the lateral side to the first reference position 92. The second region 98 is a region extending from the first reference position 92 to the second reference position 94. The third region 100 is a region extending from the second reference position 94 to an end 12*b* on the medial side.

In this case, a boundary position 102 between the restrained region 80 and the movement allowable region 82 in the medial bottom part 52 may suitably be located at a position that overlaps the second region 98 in a vertical direction. When this condition is satisfied, the restrained region 80 is provided at a position that overlaps, in a vertical direction, at least most of the first region 96 extending from the first reference position 92 toward the lateral side. Also, when this condition is satisfied, the movement allowable region 82 is provided at a position that overlaps, in a medial direction, at least most of the third region 100 extending from the second reference position 94 toward the lateral side. The "most" as used herein means a range occupying 90 percent of the entire length in a foot width direction of the relevant region. This condition is set based on experimental findings. The reason will be described.

The contact range between the foot F and the sole 12 changes variously because of a variety of causes. The "causes" include the type of the shoe, the type of the last used to make the shoe, and the position in a longitudinal direction of the foot, for example. The inventors have recognized that, in many cases, regardless of the influence of such causes, most of the contact range between the lateral side portion of the foot and the sole 12 is located in the first region 96, and the longitudinal arch on the medial side is positioned above the third region 100 with a space in between. This recognition has been obtained based on the aforementioned experimental findings. If upward force is applied to the contact range between the lateral side portion of the foot and the sole 12, force in the pronation direction will be unsuitably applied to the foot. Meanwhile, it is desirable that the longitudinal arch A on the medial side located above the third region 100 is supported from the underneath in as large a range as possible in a foot width direction Y.

When the boundary position between the restrained region 80 and the movement allowable region 82 in the medial bottom part 52 satisfies the aforementioned condition, a situation can be avoided in which force in the pronation direction is applied to the contact range between the lateral side portion of the foot and the sole 12, compared to the case where the boundary position is located at a position that overlaps the first region 96 in a vertical direction. Also, when this condition is satisfied, a large range in a foot width direction of the longitudinal arch A on the medial side located above the third region 100 can be supported from the underneath by the arch support part 84 provided in the movement allowable region 82, compared to the case where the boundary position is located in the third region 100. As a result, regardless of the influence of the various causes mentioned previously, a situation can be avoided in which force in the pronation direction is applied to the foot, while a large range of the longitudinal arch A on the medial side can be stably supported by the arch support part 84.

Second Embodiment

FIGS. 8-11 are now referred to. The shoe 10 according to the second embodiment will be described. The upper 14 includes a first upper constituent layer 110 that forms the accommodation room 18 for accommodating a foot, and a second upper constituent layer 112 disposed outside the first upper constituent layer 110. The first upper constituent layer 110 is provided as a layer for separating the inside and the outside of the upper 14, over the entire area in a longitudinal direction X and a foot width direction Y of the upper 14. The first upper constituent layer 110 has a multi-layered structure including the inner layer member 20 that forms the accommodation room 18, and the outer layer member 22 disposed outside the inner layer member 20.

The second upper constituent layer 112 is provided only in an area of the upper 14 that occupies part of the range in a longitudinal direction X and part of the range in a foot width direction Y. The second upper constituent layer 112 is disposed such as to vertically cross the aforementioned reference line L1 on the medial side in a foot width direction Y. The second upper constituent layer 112 is provided only in the medial side portion 32 of the upper 14 as the "part of the range in a foot width direction Y". The second upper constituent layer 112 forms an exposed surface of the upper 14 that is exposed to the outside. The first upper constituent layer 110 also forms an exposed surface of the upper 14 exposed to the outside, in an area other than in the second upper constituent layer 112.

A lower circumferential edge part of the first upper constituent layer 110 is fixed to the sole 12 by bonding, sewing, or the like. An outer circumferential edge part of the second upper constituent layer 112 is fixed to the first upper constituent layer 110 or the sole 12. In the present embodiment, a lower edge part of the second upper constituent layer 112 is fixed to the sole 12, and a front edge part, an upper edge part, and a rear edge part of the second upper constituent layer 112 are fixed to the first upper constituent layer 110.

The wearing opening 24 and the throat part 26 of the upper 14 are provided on the first upper constituent layer 110. Also, the multiple insertion parts 44 are provided on the first upper constituent layer 110 itself in the medial side portion 32 and the lateral side portion 34 of the upper 14.

The shoe 10 of the present embodiment does not include the support member 50 described in the first embodiment. The arch support part 84 in the present embodiment is provided in the first upper constituent layer 110. The arch support part 84 is provided on the inner side with respect to the second upper constituent layer 112. To the arch support part 84 in the present embodiment, the tightening force Fa1 in the supination direction applied to the medial side portion 32 of the upper 14 is transmitted via the first upper constituent layer 110 itself.

Figure 11:
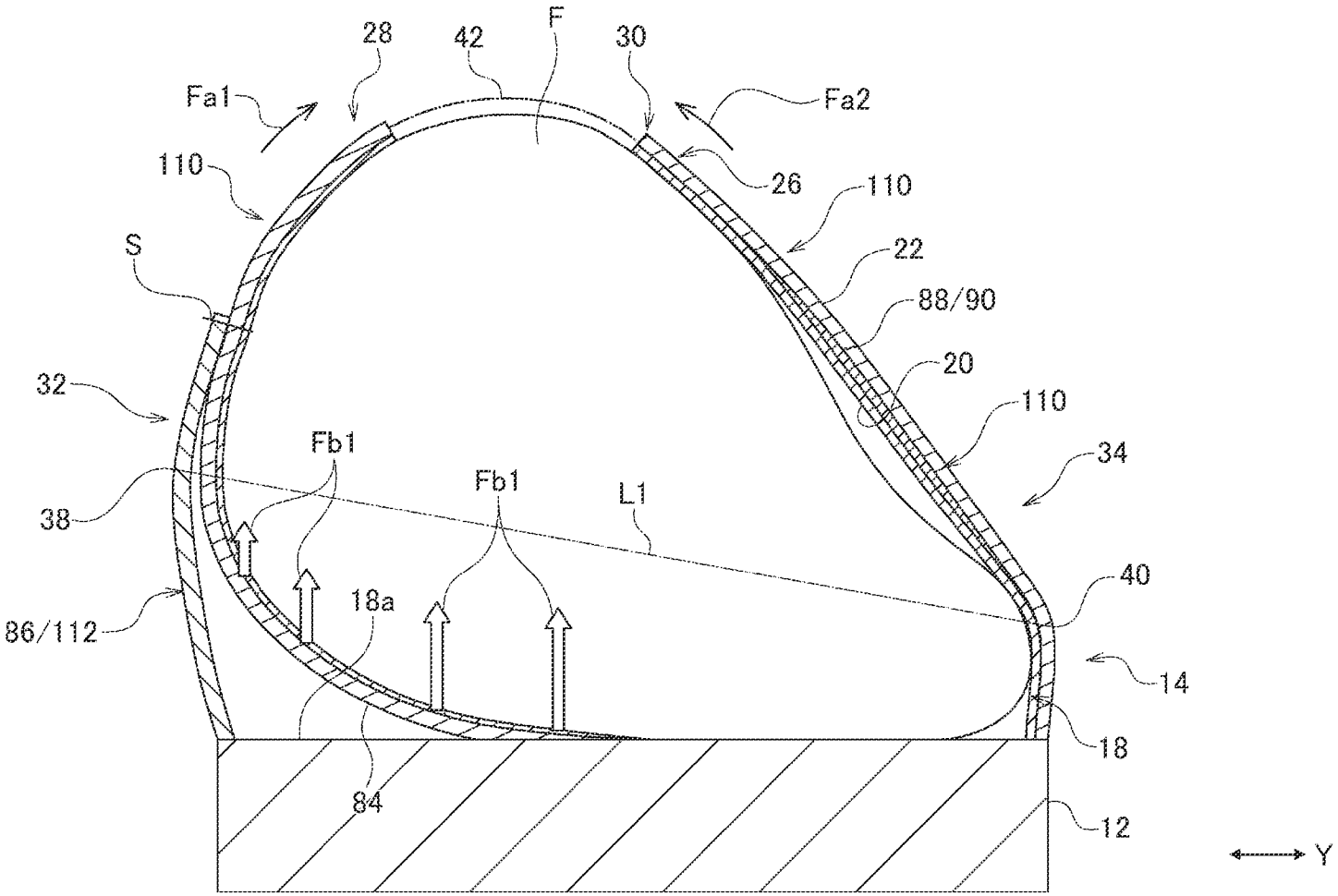
FIG. 11 is a schematic view of a cutting plane C shown in FIG. 10, viewed from a rear side.
Figure 12:
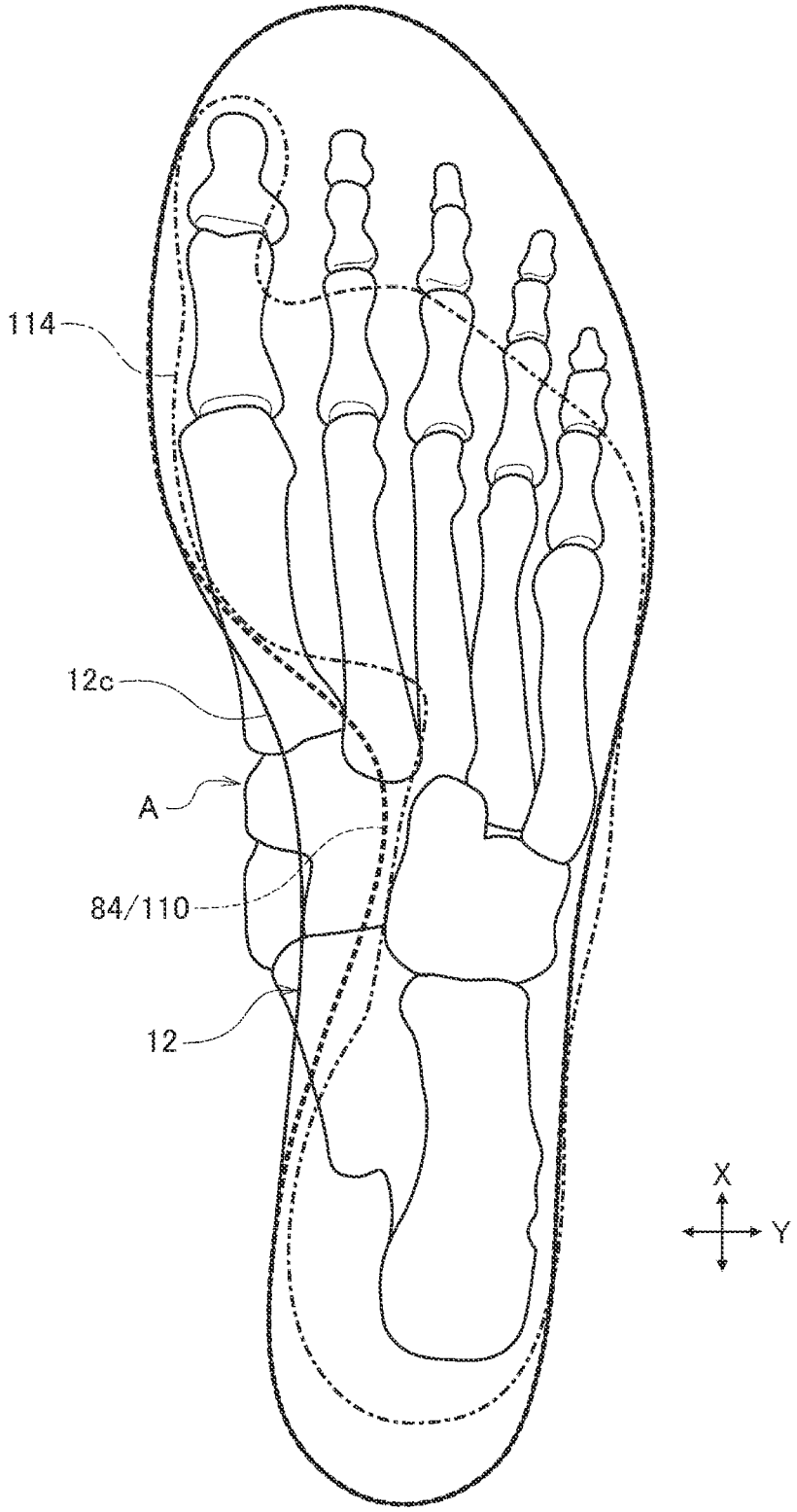
FIG. 12 is a schematic plan view in which a skeleton model of a human foot is superimposed upon an upper surface part of the sole in the second embodiment.

FIGS. 11 and 12 are now referred to. FIG. 12 shows a fixed position of the arch support part 84 (the first upper constituent layer 110) to the upper surface part of the sole 12. FIG. 12 also shows, besides the upper surface part of the sole 12, a contact region 114 of the foot F with respect to the upper surface part of the sole 12. A lower edge part of the arch support part 84 is fixed to the sole 12 by bonding, sewing, or the like in the midfoot portion of the sole 12 and on the lateral side with respect to an edge part 12*c* on the medial side of the sole 12 in plan view such as to support the longitudinal arch A on the medial side. In the present embodiment, the arch support part 84 is provided in the midfoot portion in the medial side portion 32 of the upper 14.

The description will now return to FIGS. 8-11. In the second upper constituent layer 112, the tightening force transmitter 86 is provided. In the present embodiment, the entire second upper constituent layer 112 constitutes the tightening force transmitter 86. With such a tightening force transmitter 86, when the tightening force Fa1 in the supination direction is applied to the medial side portion 32 of the upper 14, the tightening force Fa1 is transmitted from the first upper constituent layer 110 via the second upper constituent layer 112 to the tightening force transmitter 86.

As is the case in the first embodiment, the stretchability in the foot girth directions of the tightening force transmitter 86 is set higher than that of the arch support part 84. In the present embodiment, the entire second upper constituent layer 112 is made of a material having higher stretchability in the foot girth directions, compared to the first upper constituent layer 110. Accordingly, also in the present embodiment, the effect previously described in (A) can be obtained.

Also, in the present embodiment, since the first upper constituent layer 110 of the upper 14 serves dually as the arch support part 84, large asperities are less likely to occur in the accommodation room 18 formed by the first upper constituent layer 110. Accordingly, the inner surface of the accommodation room 18 feels smooth for the foot F accommodated in the accommodation room 18, providing a good fit.

In the following, other features of the shoe 10 according to the present embodiment will be described.

The shoe 10 of the present embodiment also includes the restricting part 88 constituted by the cushion member 90 similarly to the first embodiment. Also in the present embodiment, the aforementioned effects (D) and (E) can be obtained similarly to the first embodiment.

Figure 13:
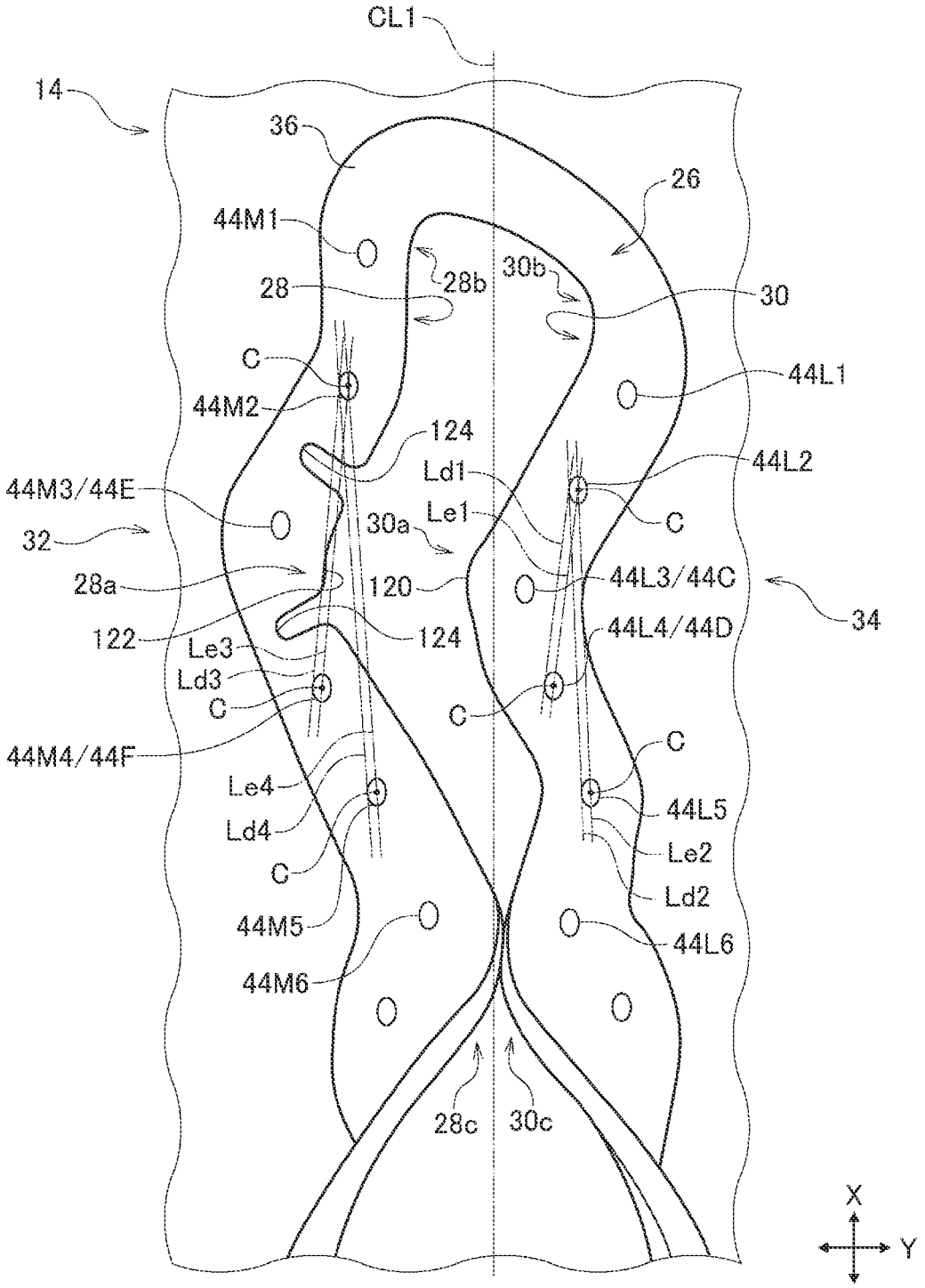
FIG. 13 is a schematic plan view of a throat part with peripheral structure thereof in the second embodiment.

FIG. 13 is now referred to. The shape of part of the upper 14 in plan view will be described. In the following, the multiple insertion parts 44 in the lateral side portion 34 of the upper 14 will be respectively given the characters "L1, L2 . . . , L6" at the ends of the reference numerals thereof serially from the front side to the rear side. Also, the multiple insertion parts 44 in the medial side portion 32 of the upper 14 will be respectively given the characters "M1, M2 . . . , M6" at the ends of the reference numerals thereof serially from the front side to the rear side.

The lateral side edge part 30 of the throat part 26 overall forms a contour projecting toward the medial side in a foot width direction Y, in a middle part 30*a* in a longitudinal direction. In the lateral side edge part 30, a convex end 120 constituted by the portion projecting toward the medial side in the contour is provided. The convex end 120 is provided at a position closer to the medial side in a foot width direction Y with respect to both ends 30*b* and 30*c* in a longitudinal direction of the lateral side edge part 30.

The aligned multiple insertion parts 44L1-44L6 provided in the lateral side portion 34 of the upper 14 include a first specific insertion part 44C (44L3) positioned closest to the medial side among the insertion parts, and a second specific insertion part 44D (44L4) positioned second closest to the medial side. These correspond to the insertion parts 44L3 and 44L4 positioned midway along a longitudinal direction X among the aligned multiple insertion parts 44L1-44L6. The first specific insertion part 44C (44L3) is positioned closer to the medial side with respect to the other insertion parts 44L1, 44L2, and 44L4-44L6. The first specific insertion part 44C is provided at a position that overlaps the convex end 120 in a foot width direction Y. The second specific insertion part 44D is positioned next to the first specific insertion part 44C in a longitudinal direction X. In the present embodiment, the second specific insertion part 44D is positioned in the rear of the first specific insertion part 44C.

A line externally tangent, from the medial side, to the two insertion parts 44L2 and 44L4 positioned next to the first specific insertion part 44C in the longitudinal directions will be referred to as a first external tangent Ld1, and a line connecting the centers C of the two insertion parts will be referred to as a first straight line Le1. The first specific insertion part 44C in the present embodiment is provided on the medial side with respect to the first external tangent Ld1. The first specific insertion part 44C in the present embodiment is also provided on the medial side with respect to the first straight line Le1.

A line externally tangent, from the medial side, to the two insertion parts 44L2 and 44L5 positioned next to the pair of the first specific insertion part 44C and the second specific insertion part 44D in the longitudinal directions will be referred to as a second external tangent Ld2, and a line connecting the centers C of the two insertion parts will be referred to as a second straight line Le2. The pair of the first specific insertion part 44C and the second specific insertion part 44D in the present embodiment are provided on the medial side with respect to the second external tangent Ld2. The pair of the first specific insertion part 44C and the second specific insertion part 44D in the present embodiment are also provided on the medial side with respect to the second straight line Le2.

The medial side edge part 28 of the throat part 26 overall forms a contour recessed toward the medial side in a foot width direction Y, in a middle part 28*a* in a longitudinal direction. In the medial side edge part 28, a recess bottom part 122 constituted by the portion recessed toward the medial side in the contour is provided. The recess bottom part 122 is provided at a position closer to the medial side in a foot width direction Y with respect to both ends 28*b* and 28*c* in a longitudinal direction X of the medial side edge part 28. The convex end 120 in the lateral side edge part 30 and the recess bottom part 122 in the medial side edge part 28 are provided at positions such as to be aligned in a foot width direction Y.

The aligned multiple insertion parts 44M1-44M6 provided in the medial side portion 32 of the upper 14 include a third specific insertion part 44E (44M3) positioned closest to the medial side among the insertion parts and a fourth specific insertion part 44F (44M4) positioned second closest to the medial side. These correspond to the insertion parts 44M3 and 44M4 positioned midway along a longitudinal direction X among the aligned multiple insertion parts 44M1-44M6. The third specific insertion part 44E (44M3) is positioned closer to the medial side with respect to the other insertion parts 44M1, 44M2, and 44M4-44M6. The third specific insertion part 44E is provided at a position that overlaps the recess bottom part 122 in a foot width direction Y. The fourth specific insertion part 44F is positioned next to the third specific insertion part 44E in a longitudinal direction X. In the present embodiment, the fourth specific insertion part 44F is positioned in the rear of the third specific insertion part 44E.

A line externally tangent, from the medial side, to the two insertion parts 44M2 and 44M4 positioned next to the third specific insertion part 44E in the longitudinal directions will be referred to as a third external tangent Ld3, and a line connecting the centers C of the two insertion parts will be referred to as a third straight line Le3. The third specific insertion part 44E in the present embodiment is provided on the medial side with respect to the third external tangent Ld3. The third specific insertion part 44E in the present embodiment is also provided on the medial side with respect to the third straight line Le3.

A line externally tangent, from the medial side, to the two insertion parts 44M2 and 44M5 positioned next to the pair of the third specific insertion part 44E and the fourth specific insertion part 44F in the longitudinal directions will be referred to as a fourth external tangent Ld4, and a line connecting the centers C of the two insertion parts will be referred to as a fourth straight line Le4. The pair of the third specific insertion part 44E and the fourth specific insertion part 44F in the present embodiment are provided on the medial side with respect to the fourth external tangent Ld4. The pair of the third specific insertion part 44E and the fourth specific insertion part 44F in the present embodiment are also provided on the medial side with respect to the fourth straight line Le4.

Thus, among the aligned multiple insertion parts 44 provided in the lateral side portion 34 of the upper 14, the first specific insertion part 44C located midway along a longitudinal direction X is positioned closer to the medial side with respect to the other insertion parts 44 provided in the lateral side portion 34. Accordingly, compared to the case where the aligned multiple insertion parts 44L1-44L6 are positioned on a straight line, an area in the lateral side portion 34 of the upper 14 which is in contact with the instep and on which the tightening force by the tightening tool 42 acts can be increased. Therefore, designing for applying large force in the supination direction to the instep can be achieved more easily, and excessive pronation in the pronation direction can be further restrained. Such designing can be achieved by providing the cushion member 90 in the lateral side portion 34 of the upper 14, for example.

Among the aligned multiple insertion parts 44 provided in the medial side portion 32 of the upper 14, the third specific insertion part 44E located midway along a longitudinal direction X is positioned closer to the medial side with respect to the other insertion parts 44 provided in the medial side portion 32. Accordingly, even when the first specific insertion part 44C provided in the lateral side portion 34 of the upper 14 is positioned closer to the medial side, the distance between the first specific insertion part 44C and the third specific insertion part 44E is less likely to be decreased. Therefore, when the tightening tool 42 is inserted through the insertion parts 44M1-44M6 and 44L1-44L6 in the medial side portion 32 and the lateral side portion 34 of the upper 14, the insertion work will be easier.

In the medial side edge part 28 of the throat part 26, a cut 124 recessed toward the medial side is formed between the insertion part 44M2 or 44M4 positioned next to the third specific insertion part 44E in a longitudinal direction X and the third specific insertion part 44E. It can be also said that a cut 124 is formed on a side in a longitudinal direction with respect to the recess bottom part 122 in the medial side edge part 28. In the present embodiment, the cut 124 is formed on each of the both sides in a longitudinal direction X with respect to the third specific insertion part 44E (recess bottom part 122) but may be formed on only one of the sides. In the present embodiment, the cuts 124 are formed only in a range that overlaps the decorative member 36 in a vertical direction in plan view. Accordingly, even when the contour of the medial side edge part 28 of the upper 14 is made to be recessed toward the medial side, flexibility of the medial side edge part 28 is favorable, providing a good fit.

Third Embodiment

Figure 14:
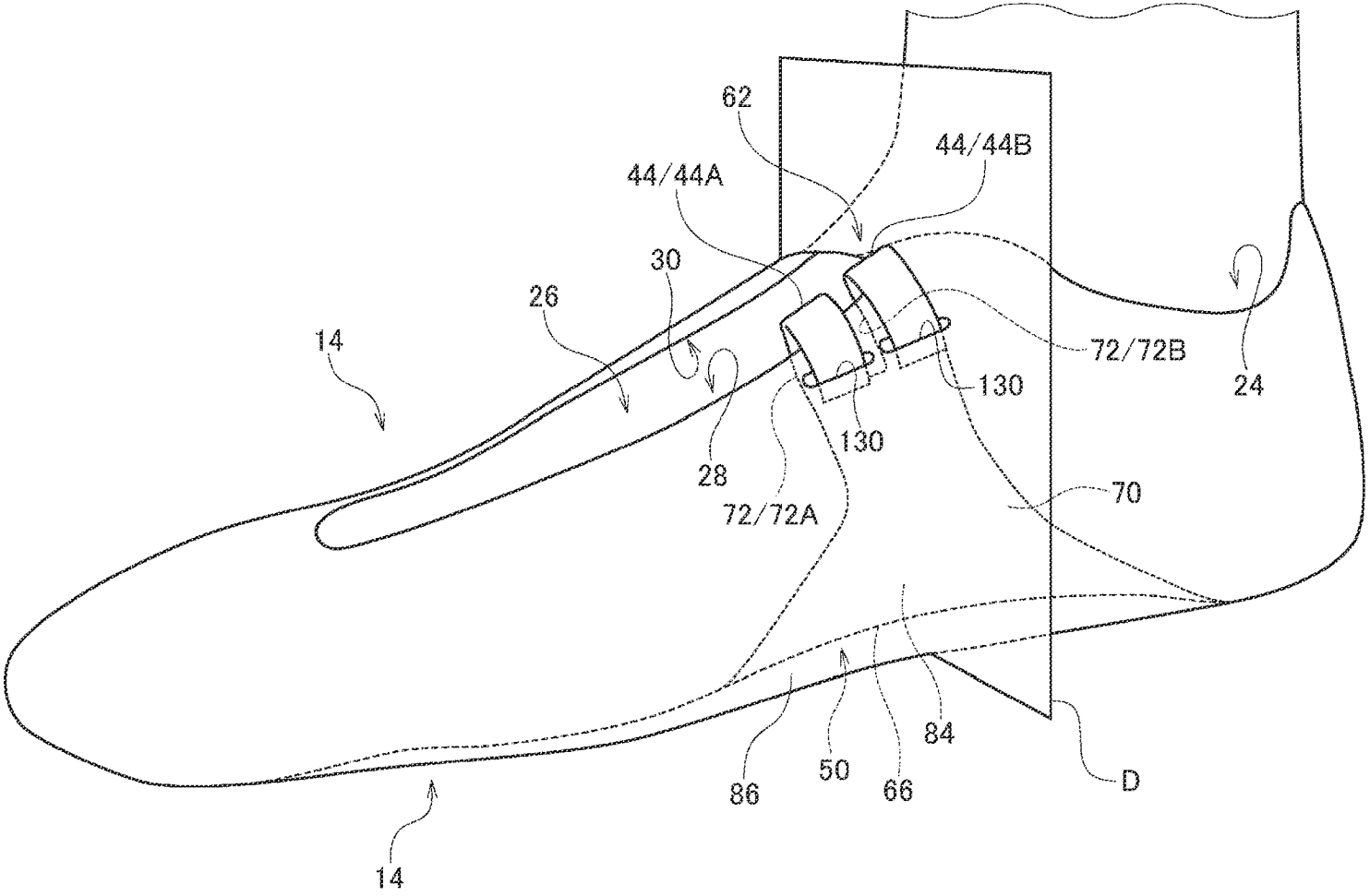
FIG. 14 is a schematic perspective view of part of a shoe according to a third embodiment viewed from a medial and front side of a foot.
Figure 15:
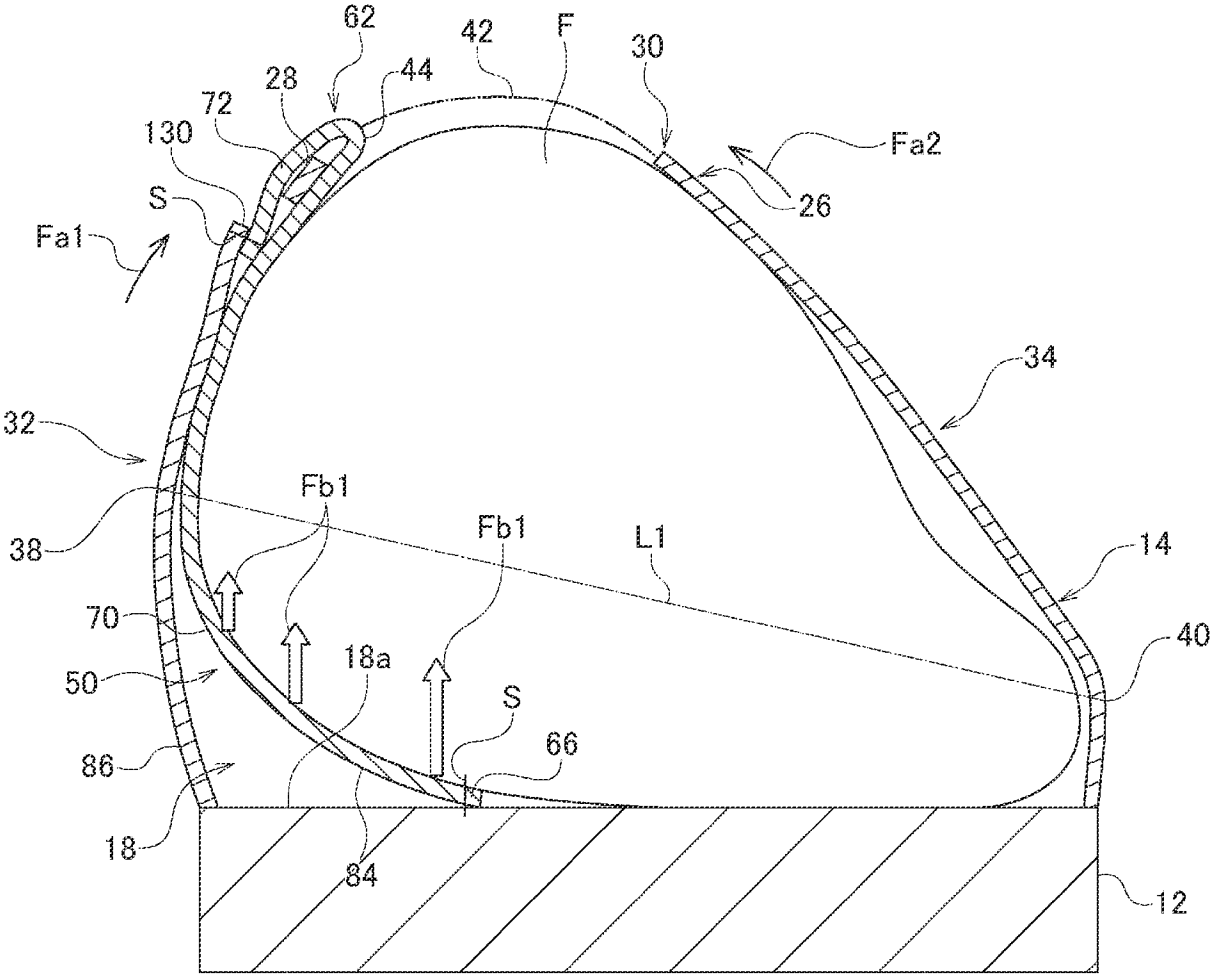
FIG. 15 is a schematic view of a cutting plane D shown in FIG. 14, viewed from a rear side.
Figure 16:
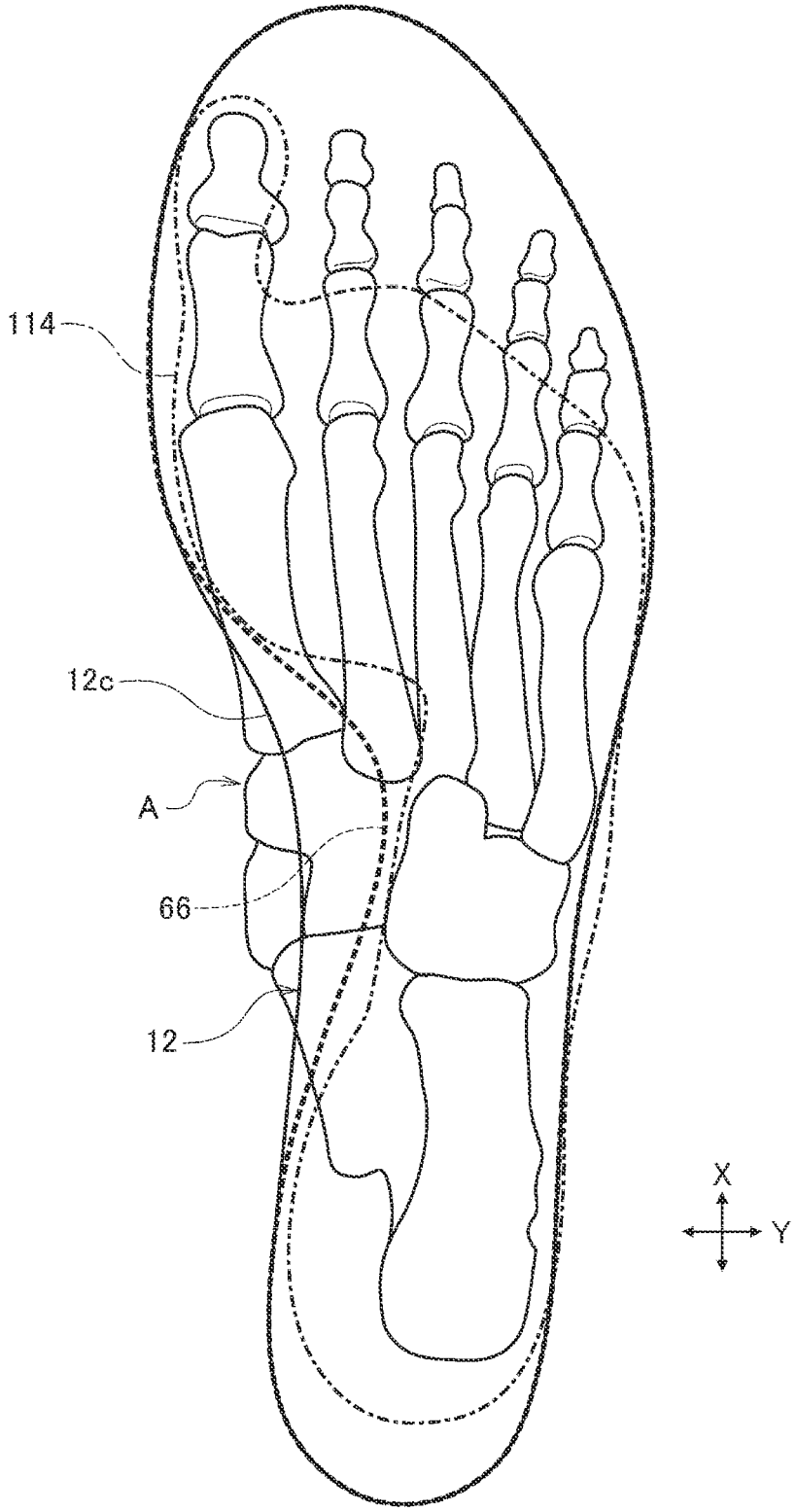
FIG. 16 is a schematic plan view in which a skeleton model of a human foot is superimposed upon an upper surface part of the sole in the third embodiment.

The shoe 10 according to the third embodiment will be described. FIGS. 14-16 are now referred to. FIG. 16 shows a fixed position of the support member 50 to the upper surface part of the sole 12.

As is the case in the first embodiment, the shoe 10 includes the support member 50 provided separately from the upper 14 and extending in a foot girth direction to form a strip shape. The support member 50 in the present embodiment is provided to extend in a foot girth direction along the medial side portion 32 of the upper 14. The one end 62 in a long side direction of the support member 50 is located in the medial side edge part 28 of the throat part 26 in the upper 14. In the one end 62 of the support member 50, an insertion part 44 is provided. An insertion part 44 in the present embodiment is constituted by the one end 62 of the support member 50 wound in a loop shape. A portion of the support member 50 on the tip side with respect to the wound portion constituting an insertion part 44 is inserted through a through hole 130 formed in the medial side portion 32 of the upper 14 and is fixed to a circumferential edge part of the through hole 130 by bonding, sewing, or the like. Accordingly, the one end 62 of the support member 50 is fixed to the medial side portion 32 of the upper 14.

In the present embodiment, multiple insertion parts 44 of the support member 50 are provided with a space in between along a longitudinal direction. The insertion parts 44 in the present embodiment include the first insertion part 44A on the front side, and the second insertion part 44B provided in the rear of the first insertion part 44A. In the present embodiment, between the first insertion part 44A and the second insertion part 44B, other insertion parts 44 directly provided in the medial side portion 32 of the upper 14 are not arranged.

The support member 50 includes the wide part 70, and a narrow part 72 that extends from the wide part 70 to the one end side of the support member 50 and has a narrower width in a longitudinal direction than the wide part 70. Multiple narrow parts 72 of the support member 50 are provided with a space in between along a longitudinal direction. The wide part 70 in the present embodiment is provided to extend in a foot girth direction along the medial side portion 32 of the upper 14, and the narrow parts 72 are constituted by the aforementioned insertion parts 44.

The arch support part 84 in the present embodiment is constituted by a partial area of the support member 50 extending from the other end 66 toward the one end side. The arch support part 84 in the present embodiment is provided in the wide part 70. The lower edge part of the arch support part 84 is fixed to the sole 12 by bonding, sewing, or the like in the midfoot portion of the sole 12 and on the lateral side with respect to the edge part 12*c* on the medial side of the sole 12 in plan view such as to support the longitudinal arch A on the medial side. In the present embodiment, the arch support part 84 is provided on the inner side with respect to the medial side portion 32 of the upper 14, at a position that overlaps the midfoot portion of the upper 14 in a foot width direction Y. To the arch support part 84 in the present embodiment, the tightening force Fa1 in the supination direction is transmitted from the insertion parts 44 of the support member 50 provided in the medial side portion 32 of the upper 14 through the support member 50 itself.

The upper 14 includes the tightening force transmitter 86 provided on the medial side with respect to the arch support part 84. The tightening force transmitter 86 in the present embodiment is constituted by a portion of the medial side portion 32 of the upper 14 located lower than each fixed position (sewn part S) of the support member 50 to the circumferential edge part of a through hole 130. To this portion, the tightening force Fa1 in the supination direction applied as described previously is transmitted via the support member 50.

The stretchability in the foot girth directions of the tightening force transmitter 86 is also set higher than that of the arch support part 84. In the present embodiment, the entire upper 14 is made of a material having higher stretchability in the foot girth directions, compared to the entire support member 50. Accordingly, also in the present embodiment, the effect previously described in (A) can be obtained.

Also, in the present embodiment, the multiple insertion parts 44 of the support member 50 are provided with a space in between along a longitudinal direction. Accordingly, the effect previously described in (B) can be obtained.

Also, the multiple insertion parts 44 are provided respectively in the multiple narrow parts 72. Accordingly, the effect previously described in (C) can be obtained.

Fourth Embodiment

Figure 17:
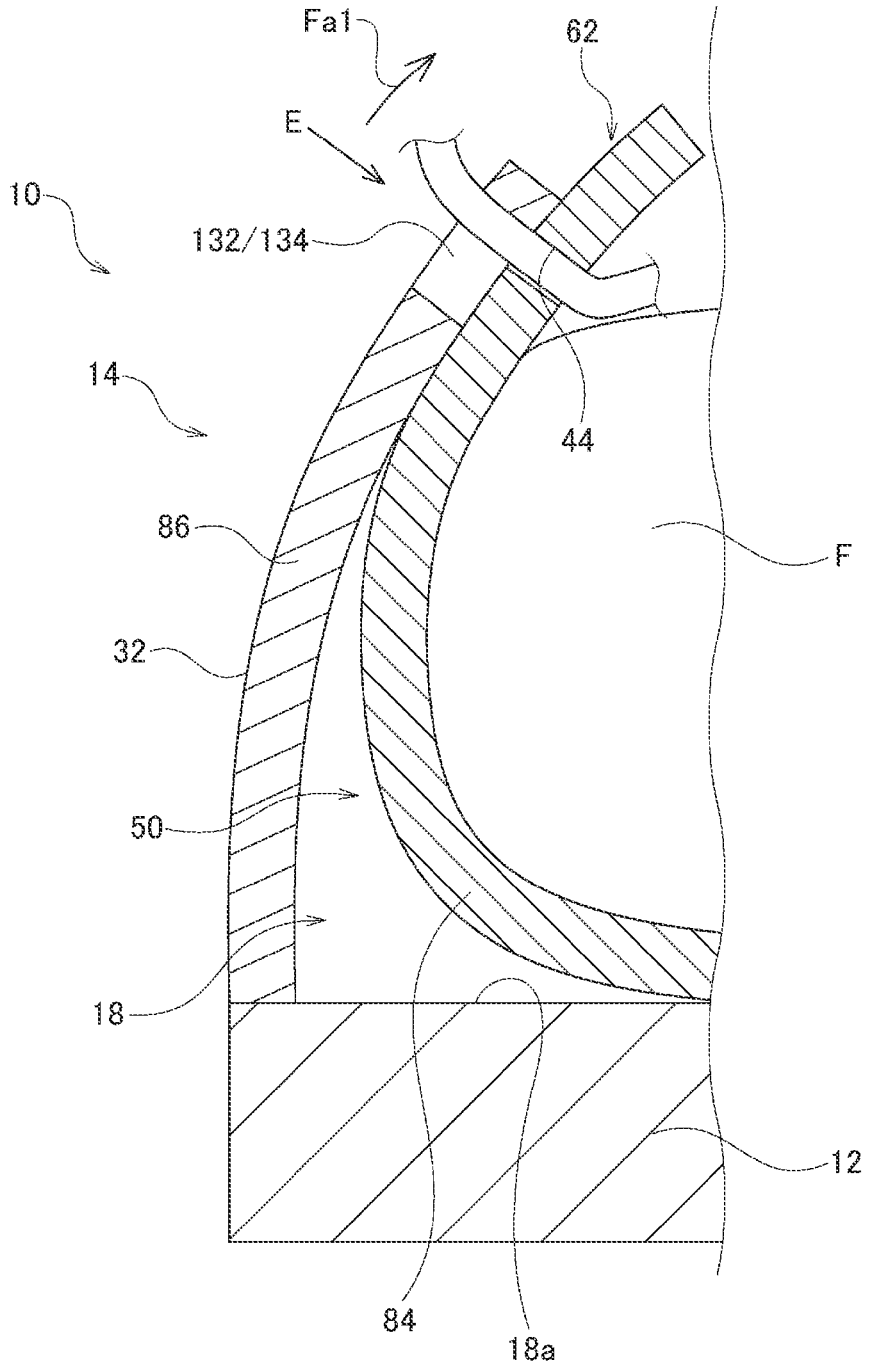
FIG. 17 is a schematic view of part of a shoe according to a fourth embodiment viewed from a rear side.
Figure 18A:
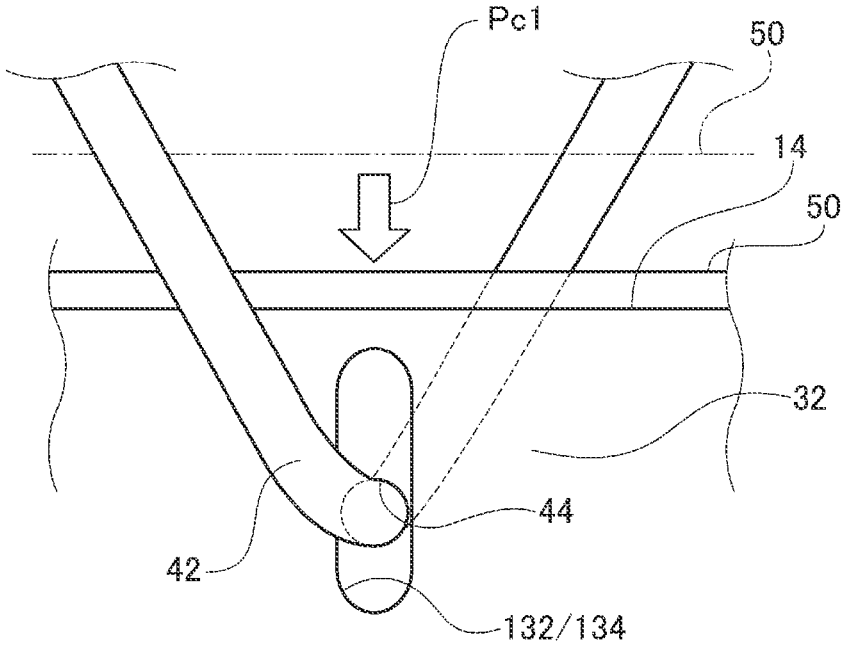
FIG. 18A is a schematic diagram that shows a state before tightening force is applied to a support member.
Figure 18B:
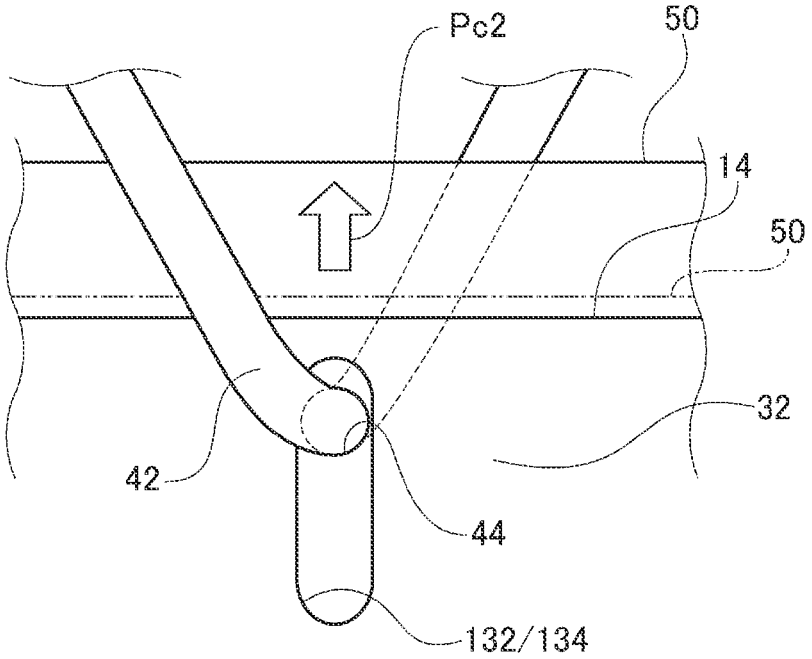
FIG. 18B is a schematic diagram that shows a state after the tightening force is applied to the support member.

The shoe 10 according to the fourth embodiment will be described. FIGS. 17 and 18 are now referred to. FIG. 18 are schematic diagrams that show states before and after the tightening force is applied to the support member 50 and also are diagrams viewed from the direction of arrow E shown in FIG. 17. Compared to the third embodiment, the shoe 10 of the present embodiment mainly differs in configurations of the upper 14 and the support member 50.

In the present embodiment, the one end 62 in a long side direction of the support member 50 is located at a position where the support member 50 is disposed over the back of the medial side portion 32 of the upper 14. In the one end 62 of the support member 50, an insertion part 44 is provided. The insertion part 44 in the support member 50 in the present embodiment is a through hole.

In the medial side portion 32 of the upper 14, another tightening tool insertion part 132 is provided at a position that overlaps the insertion part 44 in the support member 50. The tightening tool insertion part 132 in the upper 14 is a long hole 134 that is longer in a foot girth direction than the through hole constituted by the insertion part 44 in the support member 50. The tightening force transmitter 86 in the present embodiment is constituted by a portion of the medial side portion 32 of the upper 14 located lower than the lower through hole 58.

When the tightening tool 42 is loose, the tightening force Fa1 in the supination direction applied to the support member 50 is released. At the time, the insertion part 44 and the arch support part 84 of the support member 50 have moved downward in a vertical direction with respect to the sole 12 (see the direction Pc1 in FIG. 18A). Similarly, the tightening tool 42 has also moved downward in conjunction with the support member 50, near the insertion position at the insertion part 44 in the support member 50 and within the long hole 134 in the medial side portion 32 of the upper 14. Accordingly, when the tightening tool 42 is loose, the tightening tool 42 is disposed at a position away from and below an upper inner wall surface of the long hole 134.

In this state, when the tightening tool 42 is being tightened, the tightening tool 42 comes into contact with the insertion part 44 in the support member 50 but does not come into contact with the upper inner wall surface of the long hole 134 in the upper 14. When the tightening tool 42 is further tightened in this state, the tightening force Fa1 in the supination direction is applied to the support member 50 first, so that the insertion part 44 and the arch support part 84 of the support member 50 move upward (see the direction Pc2). With the amount of tightening of the tightening tool 42 increased, the tightening tool 42 comes into contact with the upper inner wall surface of the long hole 134 in the upper 14. When the tightening tool 42 is further tightened in this state, the tightening force Fa1 in the supination direction is also applied to the tightening force transmitter 86 in the medial side portion 32 of the upper 14.

Thus, the tightening force transmitter 86 in the present embodiment is configured such that, when the tightening tool 42 is being tightened, the tightening force is transmitted to the arch support part 84 before the tightening force transmitter 86. Accordingly, compared to the case where the tightening force is transmitted concurrently to the arch support part 84 and the tightening force transmitter 86, the tightening force can be transmitted to the arch support part 84 more easily. Accordingly, the amount of deformation of the tightening force transmitter 86 can be reduced, so that the repulsion caused by the deformation can also be reduced. Therefore, the tightening force transmitted to the arch support part 84 can be increased, so that the upward force in the supination direction applied from the arch support part 84 to the foot can also be increased. As a result, also in the present embodiment, the longitudinal arch A on the medial side can be firmly supported by the arch support part 84 more easily, and lowering of the longitudinal arch A can be restrained, so that excessive pronation in the pronation direction can be restrained, as previously described in (A).

Other modifications of individual constituting elements will be described.

The upper 14 may have a gusseted tongue structure. The gusseted tongue structure here means a structure in which the upper 14 and the shoe tongue 48 are formed integrally, and the upper 14 does not include the throat part 26. In this case, the medial side portion 32 of the upper 14 is constituted by a portion on the medial side with respect to the center line CL1 in the entire range in a longitudinal direction X. Also, the lateral side portion 34 of the upper 14 is constituted by a portion on the lateral side with respect to the center line CL1 in the entire range in a longitudinal direction X.

The number of insertion parts 44 in the support member 50 is not particularly limited and may also be one or three. Also, the support member 50 need not necessarily include the wide part 70 and the narrow parts 72. Further, the insertion parts 44 may be provided only in some of the multiple narrow parts 72.

When the support member 50 as described in the first, third, or fourth embodiment is used, the following configuration may be employed for an insertion part 44. That is, an insertion part 44 may be constituted by a through hole formed on part of the support member 50 placed over the back of the edge part 28 of the upper 14.

The through holes 58 and 60 formed in the medial side portion 32 of the upper 14 in the first embodiment need not necessarily communicate with the inside and the outside of the upper 14. For example, a case is assumed here in which the through holes 58 and 60 are formed only in the inner layer member 20 and not formed in the outer layer member 22 in the upper 14. In this case, the medial side part 54 is provided such as to lie between the inner layer member 20 and the outer layer member 22 of the upper 14, in a range from the insertion position at the lower through hole 58 to the insertion position at the upper through hole 60.

A specific example of the restraining part 76 is not particularly limited. For example, the restraining part 76 may be provided only in part of the sole 12 in a foot width direction Y.

The arch support part 84 has only to be provided such that the tightening force in the supination direction applied to the medial side portion 32 of the upper 14 can be transmitted thereto. To achieve this, part of the member (support member 50) constituting the arch support part 84 may be provided in the medial side portion 32 of the upper 14 so that the tightening force will be transmitted to the arch support part 84 via the member, as described in the first and third embodiments. Alternatively, the tightening force may be transmitted from the medial side portion 32 of the upper 14 to the arch support part 84 via the upper 14 itself, as described in the second embodiment.

The tightening force transmitter 86 has only to be provided such that the tightening force in the supination direction applied to the medial side portion 32 of the upper 14 can be transmitted thereto. To achieve this, part of the member (support member 50) constituting the arch support part 84 may be provided in the medial side portion 32 of the upper 14 so that the tightening force will be transmitted to the tightening force transmitter 86 via the member, as described in the first and third embodiments.

Alternatively, the tightening force may be transmitted from the medial side portion 32 of the upper 14 to the arch support part 86 via the upper 14 itself (the first upper constituent layer 110), as described in the second embodiment.

The stretchability in the foot girth directions of the tightening force transmitter 86 has only to be set higher than that of the arch support part 84. To achieve this, the materials of the tightening force transmitter 86 and the arch support part 84 may be changed, as described in the first through third embodiments, or a stretchable region, such as an accordion structure, may be provided in part of the tightening force transmitter 86.

The restricting part 88 has only to be provided in the medial side part 56 of the upper 14 to be capable of restricting upward movement of the foot, and it is not an essential to bias the instep downward. To restrict upward movement of the foot, the restricting part 88 may be constituted by the cushion member 90 fixed further inside the inner layer member 20 of the upper 14, for example.

Alternatively, the restricting part 88 may be constituted by the outer layer member 22 and the inner layer member 20 of the upper 14. In this case, the portion where the restricting part 88 is provided in the upper 14 is configured such that, in a non-deformed state, the dimension in a foot girth direction of the outer layer member 22 is larger than that of the inner layer member 20 in the upper 14. Also, in the portion where the restricting part 88 is provided in the upper 14, the inner layer member 20 is provided to be elastically stretched in a foot girth direction such as to match the outer layer member 22 in dimension in a foot girth direction. As a result, tension in a foot girth direction is applied to the inner layer member 20 because of repulsion caused by elastic deformation, and the outer layer member 22 is biased by the tension to be bent. At the time, since the outer layer member 22 is fixed at the lower circumferential edge part, the outer layer member 22 is biased to be bent with the upper portion thereof moved downward. As a result, the outer layer member 22 and the inner layer member 20 of the upper 14 function as the restricting part 88 that biases the instep downward.

Although an example has been described in which the second upper constituent layer 112 in the second embodiment is provided only in part of the entire range in a longitudinal direction of the upper 14, the second upper constituent layer 112 may be provided in the entire range. Also, although an example has been described in which the second upper constituent layer 112 is provided only in the medial side portion 32 of the upper 14, the second upper constituent layer 112 may be provided in the lateral side portion 34.

The shapes of both the edge parts 28 and 30 of the throat part 26 are not particularly limited in each embodiment. Also, even when the contour of the lateral side edge part 30 of the throat part 26 is made to project toward the medial side, the contour of the medial side edge part 28 may be made to extend linearly.

Exemplary embodiments and modifications of the present invention have been described in detail. Each of the abovementioned embodiments and modifications merely describes a specific example for carrying out the present invention. The embodiments and modifications are not intended to limit the technical scope of the present invention, and various design modifications, including changes, addition, and deletion of constituting elements, may be made to the embodiments or modifications without departing from the scope of ideas of the invention. In the aforementioned embodiments, matters to which design modifications may be made are emphasized with the expression of "embodiment", but design modifications may also be made to matters without such expression. The hatching provided on the cross sections in the drawings is not provided to limit the materials of the objects with the hatching.

Also, optional combinations of the abovementioned constituting elements may also be employed as additional aspects of the present invention. For example, with an embodiment, an arbitrary matter described in another embodiment or a modification may be combined. Also, with a modification, an arbitrary matter described in an embodiment or another modification may be combined. Examples of such combinations will be described.

The positional relationships among the multiple insertion parts 44 in the second embodiment may be applied to the multiple insertion parts 44 in the first, third, or fourth embodiment. Also, the positional relationships among the multiple insertion parts 44 in the first, third, or fourth embodiment may be applied to the multiple insertion parts 44 in the second embodiment.

The support member 50 described in the first, third, or fourth embodiment may be used for the shoe 10 of the second embodiment. Also, the upper constituent layers 110 and 112 described in the second embodiment may be used for the shoe 10 of the first or third embodiment.

With the shoe 10 of the fourth embodiment, a matter described in the first through third embodiments may be combined. For example, for the shoe 10 of the fourth embodiment, the support member 50 described in the first embodiment may be used, or the upper constituent layers 110 and 112 described in the second embodiment may be used.

Each of the aforementioned embodiments and modifications describes a shoe with which excessive pronation in the pronation direction can be restrained. Meanwhile, the present invention is also applicable to a shoe with which supination in the supination direction can be restrained. In the case of application to such a shoe, the description in the embodiments and modifications may be construed such as to satisfy the following conditions (1)-(3). In this case, it is construed that the first side of the foot width directions described previously is the lateral side, and the second side thereof is the medial side. Also, it is construed that the first side of the foot girth directions is the pronation direction, and the second side thereof is the supination direction.

(1) The description in the embodiments and modifications is construed such that, in a foot width direction, the "medial side" is replaced by the "lateral side", and the "lateral side" is replaced by the "medial side".

(2) The description in the embodiments and modifications is construed such that the "supination direction" is replaced by the "pronation direction", and the "pronation direction" is replaced by the "supination direction".

(3) The description in the embodiments and modifications is construed such that the "pronation" is replaced by the "supination".

For example, to obtain the aforementioned effect (A) described in the first embodiment, the arch support part 84 of the shoe 10 is provided such that the tightening force Fa2 in the pronation direction applied to the medial side portion 32 of the upper 14 can be transmitted thereto, so that the arch support part 84 can support, from the underneath, the wearer's longitudinal arch on the lateral side (lateral longitudinal arch). Also, the tightening force transmitter 86 of the upper 14 is provided on the lateral side with respect to the arch support part 84 such that the tightening force in the pronation direction applied to the medial side portion 32 of the upper 14 can be transmitted thereto. Further, the stretchability in the foot girth directions of the tightening force transmitter 86 has only to be set higher than that of the arch support part 84.

Accordingly, when the tightening force in the pronation direction is applied to the medial side portion 32 of the upper 14, the tightening force transmitter 86 of the upper 14 is more likely to be deformed, compared to the case where the stretchability of the tightening force transmitter 86 is made identical with the stretchability of the arch support part 84. This can increase the tightening force transmitted to the arch support part 84, thereby increasing the upward force in the pronation direction applied from the arch support part 84 to the foot. As a result, the longitudinal arch on the lateral side can be firmly supported by the arch support part 84 more easily, and lowering of the longitudinal arch can be restrained, so that supination in the supination direction can be restrained.

Also, to obtain the effects described in the fourth embodiment with a shoe with which supination can be restrained, the tightening force transmitter 86 may be configured such that, when the tightening tool 42 is being tightened, the tightening force is transmitted to the arch support part 84 before the tightening force transmitter 86, as is the case in the fourth embodiment.

When the inventions embodied by the embodiments and modifications set forth above are generalized, it can be said that the inventions described in the following items are included.

(First Item)

A shoe, comprising:

an upper; and a tightening tool disposed above an instep of a wearer and capable of applying, to the upper, tightening force for drawing portions on the both sides in a foot width direction of the upper, wherein the upper comprises a first side portion provided on the first side in a foot width direction, and a second side portion provided on the second side in a foot width direction, in each of the first side portion and the second side portion, a plurality of tightening tool insertion parts aligned with a space in between along a longitudinal direction are provided, and among the plurality of tightening tool insertion parts in the second side portion, a tightening tool insertion part located midway along a longitudinal direction is positioned closer to the first side in the foot width direction with respect to the other tightening tool insertion parts.

(Second Item)

The shoe according to First Item, wherein, among the plurality of tightening tool insertion parts in the first side portion, a tightening tool insertion part located midway along a longitudinal direction is positioned closer to the first side in the foot width direction with respect to the other tightening tool insertion parts.

A purpose of the inventions described in the above items is to provide a shoe with which excessive pronation can be restrained.

INDUSTRIAL APPLICABILITY

The present invention relates to a shoe.

REFERENCE SIGNS LIST

10 shoe
12 sole
12*a*, 12*b* end
14 upper
18 accommodation room
24 wearing opening
26 throat part
28 medial side edge part (first side edge part)
30 lateral side edge part (second side edge part)
32 medial side portion (first side portion)
34 lateral side portion (second side portion)
42 tightening tool
44 tightening tool insertion part
50 support member
52 medial bottom part
62 one end
66 the other end
70 wide part
72 narrow part
76 restraining part
80 restrained region
82 movement allowable region
84 arch support part
86 tightening force transmitter
88 restricting part
110 first upper constituent layer
112 second upper constituent layer

The invention claimed is:

1. A shoe, comprising:

an upper;

a tightening tool disposed above an instep of a wearer and capable of applying, to the upper, tightening force for drawing portions on the both sides in a foot width direction of the upper; and an arch support part provided such that a tightening force applied to a first side portion in a foot width direction of the upper can be transmitted thereto, the arch support part being also provided to be capable of supporting, from the underneath, a longitudinal arch on a first side in the foot width direction of a foot of a wearer, wherein the first side portion comprises a tightening force transmitter provided on the first side in the foot width direction with respect to the arch support part and also provided such that the tightening force applied to the first side portion can be transmitted thereto, the arch support part is provided in a support member that is a member separated from the upper and extends in a foot girth direction to form a strip shape, the support member comprises:

a medial bottom part that is disposed on a sole, that is provided to be movable in the foot girth direction with respect to the sole, and in which the arch support part is provided;

a first side part provided on the first side in the foot width direction with respect to the medial bottom part and also provided such that the tightening force applied to the first side portion can be transmitted thereto; and a second side part provided on a second side in the foot width direction with respect to the medial bottom part and fixed to the upper, a tightening tool insertion part is provided to pass through one end in a long side direction of the support member provided in the first side part without being provided to pass through the other end in the long side direction of the support member provided in the second side part, and the first side part is provided to extend in the foot girth direction along a medial side portion of the upper, an upper through hole and a lower through hole are formed in the medial side portion of the upper at positions vertically spaced away from each other, and the medial side portion is movably inserted through the upper through hole and the lower through hole such as to be exposed to an external space.

2. A shoe comprising:

an upper disposed on a medial side and a lateral side of the shoe to define an interior of the shoe, the upper including an inner surface facing the interior of the shoe and an outer surface facing away from the interior of the shoe, the upper including a throat between the medial side and the lateral side of the shoe;

a support member disposed in the interior of the shoe and on the medial side of the shoe, the support member including an arch support part that is adapted to be positioned at an arch of a wearer of shoe when the wearer wears the shoe, the support member extending from the arch support part along the inner surface of the upper toward the throat, the support member including an end portion that is exposed to an exterior of the shoe from the throat; and a tightening tool disposed over the throat, the tightening tool being connected to the end portion of the support member to apply a tightening force to the upper through the support member, wherein the support member comprises a tightening force transmitter that is disposed between the arch support part and the end portion of the support member, wherein the upper includes a first through-hole and a second through-hole, wherein the tightening force transmitter of the support member is threaded through the first through-hole of the upper from the interior to the exterior of the shoe to be exposed to the exterior of the shoe and further threaded through the second through-hole of the upper from the exterior to the interior of the shoe such that the tightening force transmitter extends along the outer surface of the upper on the medial side of the shoe between the first through-hole and the second through-hole of the upper, and wherein, when the tightening tool is tightened, the tightening force is transmitted from the end portion of the support member to the upper via the tightening force transmitter such that the tightening force i) from the tightening tool is transmitted to the end portion of the support member, ii) from the end portion of the support member to the tightening force transmitter of the support member, and iii) from the tightening force transmitter of the support member to the upper via a portion of the upper where the tightening force transmitter overlaps resulting to the tightening force being transmitted to the support member before the tightening force is transmitted to the upper.

3. The shoe according to claim 1, wherein the support member comprises the tightening tool insertion part, and a plurality of the tightening tool insertion parts are provided with a space in between along a longitudinal direction.

4. The shoe according to claim 3, wherein the support member comprises a wide part in which the arch support part is provided and a plurality of narrow parts that each extend from the wide part to one end side in the long side direction of the support member and that each have a narrower width in a longitudinal direction than the wide part, and the plurality of tightening tool insertion parts are provided respectively in the plurality of narrow parts.

5. The shoe according to claim 1, wherein the upper comprises a second side portion provided on the second side in the foot width direction, and the upper comprises a restricting part provided in the second side portion and capable of restricting, in a state where the longitudinal arch on the first side in the foot width direction is supported by the arch support part, upward movement of the foot of the wearer.

6. The shoe according to claim 5, wherein, in a state where the longitudinal arch on the first side in the foot width direction is supported by the arch support part, the restricting part biases the instep downward.

7. The shoe according to claim 1, further comprising a restraining part that restrains movement in a vertical direction of the medial bottom part with respect to the sole but allows movement in the foot girth direction of the medial bottom part with respect to the sole, wherein the medial bottom part comprises:

a restrained region that is provided on the second side in the foot width direction in the medial bottom part and in which movement in the vertical direction is restrained by the restraining part; and a movement allowable region that is provided on the first side in the foot width direction in the medial bottom part with respect to the restrained region and in which movement in the vertical direction is not restrained by the restraining part, and the arch support part is provided in the movement allowable region.

* * * * *